US012674323B2

(12) United States Patent
Stulc

(10) Patent No.: US 12,674,323 B2
(45) Date of Patent: Jul. 7, 2026

(54) ROOF PANELS AND RELATED STRUCTURES, AND ASSOCIATED SYSTEMS AND METHODS

(71) Applicant: Renovate Robotics, Inc., Spokane, WA (US)

(72) Inventor: Andrew Stulc, New York, NY (US)

(73) Assignee: RENOVATE ROBOTICS, INC., Spokane, WA (US)

( * ) Notice: Subject to any disclaimer, the term of this patent is extended or adjusted under 35 U.S.C. 154(b) by 0 days.

(21) Appl. No.: 19/274,973

(22) Filed: Jul. 21, 2025

(65) Prior Publication Data

US 2026/0028821 A1 Jan. 29, 2026

Related U.S. Application Data

(60) Provisional application No. 63/675,079, filed on Jul. 24, 2024.

(51) Int. Cl.
*E04D 3/35* (2006.01)
*E04D 3/36* (2006.01)

(52) U.S. Cl.
CPC ..... *E04D 3/352* (2013.01); *E04D 3/3605* (2013.01)

(58) Field of Classification Search
CPC . E04D 1/265; E04D 1/262916; E04D 1/2918; E04D 1/2963; E04D 1/3405; E04D 2001/303; E04D 2001/3426; E04D 2001/3441; E04D 2001/345; E04D 2001/3458; E04D 2001/3467; E04D 2001/3476; E04D 2001/3482; E04D 2001/3491; E04D 2001/3494; E04D 3/02; E04D 3/351; E04D 3/352; E04D 3/354; E04D 3/3601; E04D 3/3603; E04D 3/3605; E04D 3/3606; E04D 3/3608; E04D 11/02; E04D 13/1618; E04D 2001/3423; E04D 2001/3452; E04D 3/35; E04D 3/3607
See application file for complete search history.

(56) References Cited

U.S. PATENT DOCUMENTS 2,164,712 A * 7/1939 Kirschbraun ..... E04D 1/28 52/540
2,384,686 A * 9/1945 Kraus ..... E04F 13/0864 52/409
2,411,771 A * 11/1946 Beasley ..... E04D 1/265 52/519

(Continued)

FOREIGN PATENT DOCUMENTS

WO WO-9406978 A1 * 3/1994 ..... E04D 1/265

*Primary Examiner* — Kyle J. Walraed-Sullivan
(74) *Attorney, Agent, or Firm* — Perkins Coie LLP

(57) ABSTRACT

Roof panels to be installed on a roof, and associated systems and methods are disclosed herein. In some embodiments, a roof panel includes a structural layer, a protective layer disposed over the structural layer, and a plurality of shingles disposed over the protective layer and arranged in rows. The protective layer can protect the structural layer and/or the roof from elements. Each of the shingles can include top, middle, and bottom portions. Individual shingles in adjacent rows can at least partially overlap such that the bottom portions of shingles in a second row at least partially cover the top portions and the middle portions of shingles in a first row immediately below the second row. The roof panel can be prefabricated off-site, transported, and installed on the roof on-site.

19 Claims, 32 Drawing Sheets

(56) References Cited

U.S. PATENT DOCUMENTS 3,546,843 A * 12/1970 Luebs ..... E04D 1/265 52/557
3,809,598 A * 5/1974 Ferguson ..... E04D 1/265 428/464
4,050,209 A * 9/1977 Barker ..... E04D 1/2984 52/553
4,160,346 A * 7/1979 Kaufmann ..... C08L 33/00 52/96
4,288,959 A * 9/1981 Murdock ..... E04D 1/265 52/518
4,386,136 A * 5/1983 Kaufmann ..... E04D 13/002 428/451
4,731,970 A * 3/1988 Marshall ..... E04D 1/265 52/551
5,070,670 A * 12/1991 Alderson ..... E04D 3/352 52/410
5,433,050 A * 7/1995 Wilson ..... E04D 13/172 52/302.1
12,158,004 B2 12/2024 Stulc
2004/0148884 A1* 8/2004 Jacques ..... E04D 1/265 52/302.1
2004/0226247 A1* 11/2004 Byrd ..... E04D 3/358 52/518
2007/0294977 A1* 12/2007 Mitchell ..... E04D 1/3405 52/543
2008/0236058 A1* 10/2008 Antonie ..... E04D 13/17 52/302.1
2013/0305642 A1* 11/2013 Propst ..... F24S 20/69 52/309.3
2016/0222667 A1* 8/2016 Anderson ..... E04D 1/2918
2017/0328064 A1* 11/2017 Hill ..... E04C 2/44
2018/0355615 A1* 12/2018 Jenkins ..... E04B 7/22
2019/0376287 A1* 12/2019 Bennett ..... E04D 13/1618
2020/0091856 A1* 3/2020 Wakeman ..... E04D 3/02
2020/0141122 A1* 5/2020 Whitridge, Jr. ..... E04D 1/14
2022/0074205 A1* 3/2022 Bennett ..... E04C 2/16

* cited by examiner

ROOF PANELS AND RELATED STRUCTURES, AND ASSOCIATED SYSTEMS AND METHODS

CROSS-REFERENCE TO RELATED APPLICATION(S)

The present application claims the benefit of U.S. Provisional Patent Application No. 63/675,079, filed Jul. 24, 2024, the disclosure of which is incorporated herein by reference in its entirety.

TECHNICAL FIELD

The present technology generally relates to roof panels and related structures configured to be installed on a roof, and associated systems and methods.

BACKGROUND

The number of new buildings constructed has significantly increased over the past few decades. Moreover, the amount of climate-related damage to existing buildings and infrastructure continues to grow, which has increased demand for construction labor. Roof installation and maintenance, however, can be a slow and labor-intensive process, requiring various materials such as shingles, nails, drip edges, flashings, and various tools to be transported from the ground to the roof and individually installed. Installing shingles on a roof can also require a certain skill level, as shingles must be cut to fit around various roof penetrations (e.g., chimneys, vents, skylights), aligned correctly, and installed properly to provide effective protection against the elements. Therefore, construction labor can be costly, time-consuming, and difficult to source. There is a need to reduce the required labor involved in the management of roofs and other surfaces of structures.

BRIEF DESCRIPTION OF THE DRAWINGS

Features, aspects, and advantages of the presently disclosed technology may be better understood with regard to the following drawings.

Figure 1:
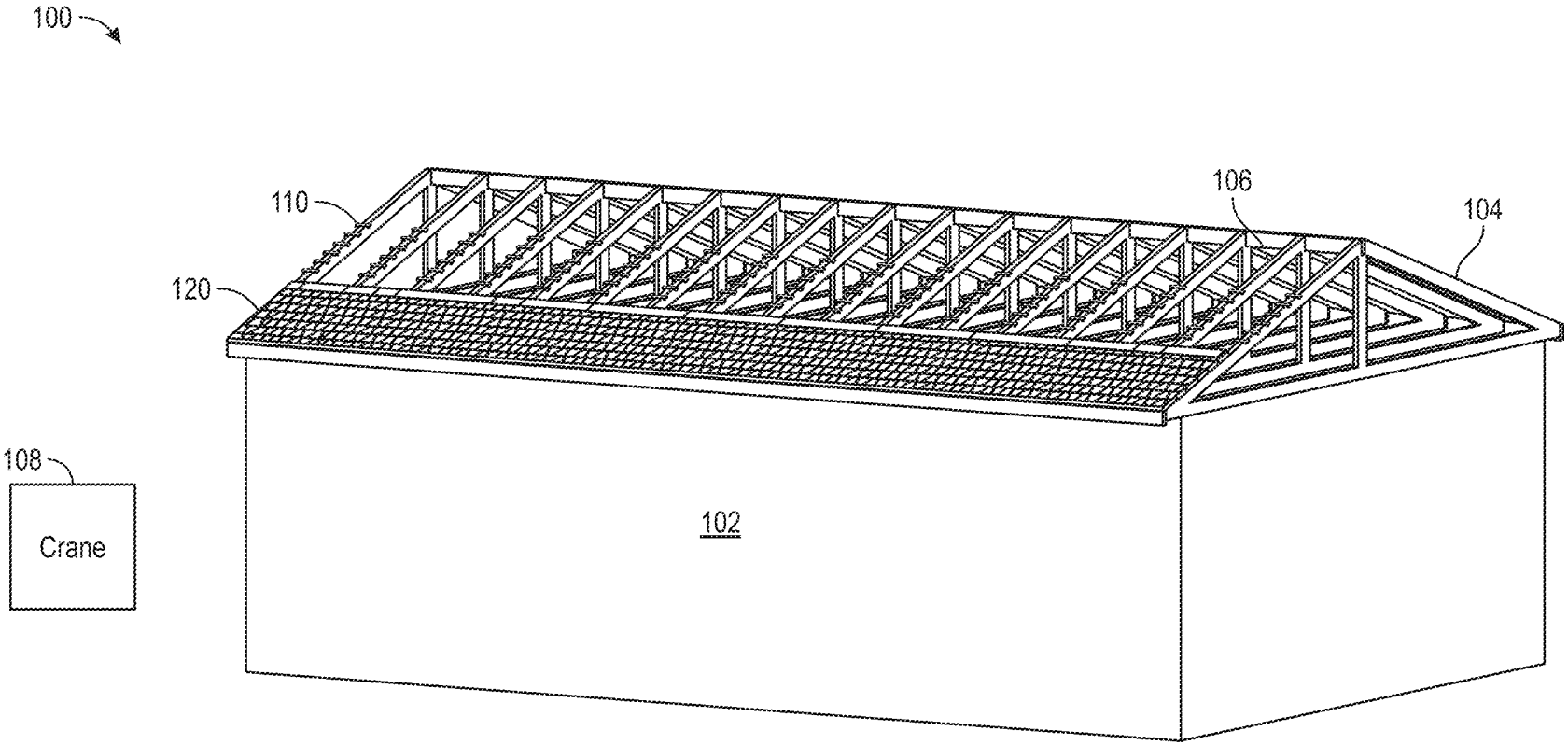
FIG. 1 is a perspective view of a roof panel installation system, configured in accordance with embodiments of the present technology.

A person skilled in the relevant art will understand that the features shown in the drawings are for purposes of illustrations, and variations, including different and/or additional features and arrangements thereof, are possible.

DETAILED DESCRIPTION

I. Overview

Embodiments of the present technology are directed to roof panels configured to be installed on a roof or other angled surface, and associated systems and methods. Conventional roof shingles are often installed one at a time, requiring a significant amount of on-site labor. For example, a construction worker must position each shingle, align the shingle properly, and secure the shingle with nails, often using a hammer or pneumatic nail gun. This process is repeated for each shingle row-by-row, e.g., starting from the bottom edge of the roof and working upwards. The labor-intensive nature of this process not only increases the time required to complete a roofing project but also elevates the overall cost due to the extensive labor involved. Additionally, the need for precise alignment and secure fastening of each shingle demands a high level of skill and attention to detail, further contributing to the complexity and duration of the installation process.

Embodiments of the present technology address at least some of the above-described issues. For example, embodiments of the present technology include roof panels that can be manufactured off-site (e.g., by robots at a factory), transported to the site of installation (e.g., a residential house), and installed on a roof. As discussed further herein, each roof panel can include a plywood layer, a protective layer, a layer of multiple shingles, and/or other components typically included in roofing, such as drip edges and flashings.

By pre-fabricating roof panels off-site, the required on-site labor, and thus the associated time and costs, can be reduced to placing the panels onto rafters of the roof (e.g., via a crane), coupling the panels to the rafters, and coupling the panels to one another. Also, because the shingles are properly aligned and packaged on the panels off-site, the minimum skill level required for the on-site labor is significantly reduced. Moreover, the roof panels can be used on various types of roofs (e.g., gable roofs, hip roofs) and can be customized at the off-site prefabrication stage to account for any roof penetrations. The methods described herein can also be applied to placing solar panels, solar panel racks, and/or other related structures on roofs or other angled surfaces.

In the Figures, identical reference numbers identify generally similar, and/or identical, elements. Many of the details, dimensions, and other features shown in the Figures are merely illustrative of particular embodiments of the disclosed technology. Accordingly, other embodiments can have other details, dimensions, and features without departing from the spirit or scope of the disclosure. In addition, those of ordinary skill in the art will appreciate that further embodiments of the various disclosed technologies can be practiced without several of the details described below.

II. Select Embodiments of Roof Panels and Related Structures

FIG. 1 is a perspective view of a roof panel installation system 100 ("the system 100"), configured in accordance with embodiments of the present technology. As discussed further herein, the system 100 can operate relative to a structure 102 (e.g., a residential building, a commercial building, an industrial building, etc.) with a roof or angled surface 104 ("roof 104"). In the illustrated embodiment, the roof 104 comprises a gable roof and includes a plurality of trusses or rafters 106 extending downward from the ridge of the roof 104 at an angle. The system 100 can include a plurality of brackets 110 and one or more roof panels 120, which can be installed by a machine 108 (shown schematically), such as a crane or other machinery.

Prior to installing the one or more roof panels 120 on the roof 104, an operator or apparatus (not shown) can install the plurality of brackets 110 on the rafters 106 using fasteners. Multiple brackets 110 can be installed on each rafter 106, as shown. The machine 108 can then be operated (e.g., via an operator and/or an algorithm) to lift the roof panels 120 one at a time and place them on the rafters 106. While FIG. 1 illustrates a single cave roof panel placed along the cave of the roof 104, the system 100 can include one or more subsequent roof panels stacked above the illustrated cave roof panel 120 along the rafters 106 to cover the roof 104. Once the roof panels 120 are placed on the rafters 106, an operator or apparatus can couple the roof panels 120 to the brackets 110, and thus to the rafters 106, using fasteners. An operator or apparatus can also couple adjacent roof panels 120 together, as discussed in further detail herein.

In some embodiments, the one or more roof panels 120 are fabricated off-site (e.g., by robots at a factory) prior to on-site installation. The prefabricated roof panels 120 can be transported (e.g., via a truck) from the off-site fabrication location to the on-site location (e.g., at the structure 102). Transportation parameters (e.g., the size of the truck), material properties, and/or other factors can affect the size and dimensions of each of the roof panels 120. In FIG. 1, the roof panel 120 extends across the entire width of the roof 104, but does not extend along the full length of the rafters 106, requiring additional roof panels 120 to be placed to cover the roof 104. In other embodiments, the roof panels 120 can have other dimensions. In some embodiments, the roof panels 120 are customized to the specific structure 102. For example, during off-site fabrication of the roof panels 120, each roof panel 120 can be sized to extend along half of the width of the particular structure 102, which is a value that can be measured easily.

Figure 2:
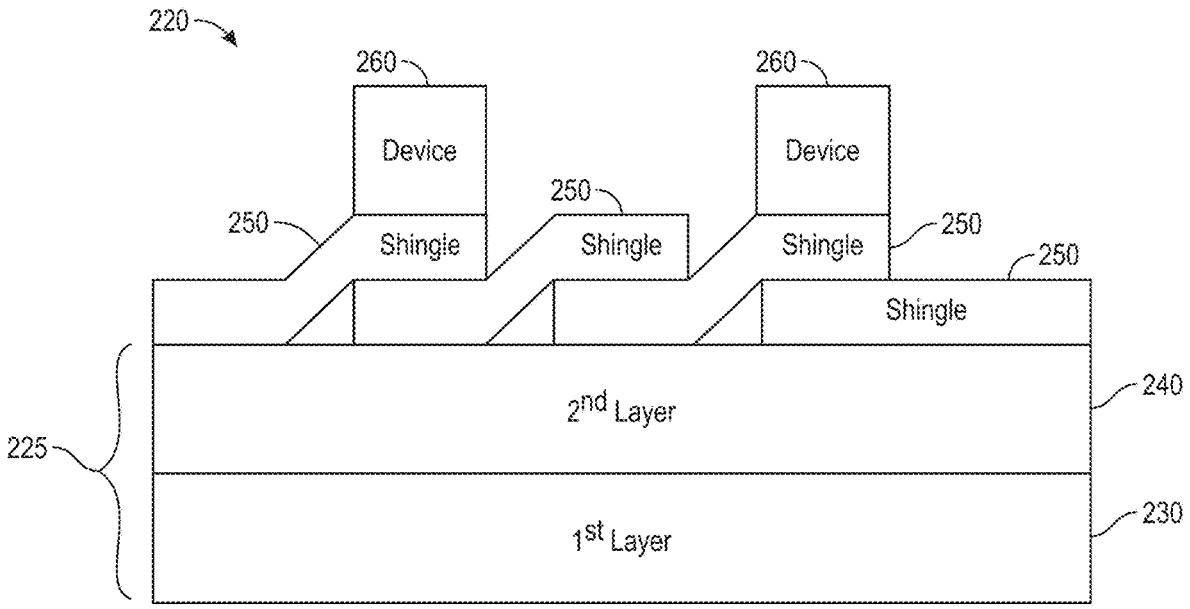
FIG. 2 is a schematic diagram of a roof panel, configured in accordance with embodiments of the present technology.

FIG. 2 is a schematic diagram of a roof panel 220, configured in accordance with embodiments of the present technology. The roof panel 220 can be an example of the roof panel 120 of FIG. 1. The roof panel 220 can include a base member 225, a plurality of shingles 250 over (e.g., directly on) the base member 225, and optionally one or more devices 260. The base member 225 can include a first layer 230 and a second layer 240 over (e.g., directly on) the first layer 230. The plurality of shingles 250 can partially overlap with one another, as schematically illustrated, and can be disposed over the second layer 240. In some embodiments, the first layer 230 comprises a roof decking or sheathing layer, and can include plywood, oriented strand board (OSB), and/or other suitable materials. The first layer 230 can provide the structural base for the roof panel 220 and can be attached (e.g., directly attached) to rafters of a roof (e.g., the rafters 106 of FIG. 1). In some embodiments, the second layer 240 comprises a protective layer (e.g., an underlayment and/or an ice and water shield (IWS) layer). The second layer 240 can provide a desired level of protection or waterproofing to prevent water damage to the first layer 230 and the underlying roof and structure.

In some embodiments, the shingles 250 comprise asphalt, fiberglass matt, composites thereof, and/or other suitable materials for providing protection against the elements. In some embodiments, the shingles 250 include granules made of minerals, ceramics, and/or other suitable materials on the external surface for additional protection and/or aesthetics. The shingles 250 can be arranged in a plurality of rows and a plurality of staggered columns. In some embodiments, the shingles 250 exhibit a minimum level of flexibility. As discussed further herein, the ability of the shingles 250 to bend can allow efficient installation of the roof panels 220.

In some embodiments, the devices 260 comprise solar panels, rack mounts for solar panels, inverters, wire penetrations, etc. The devices 260 can be disposed on the shingles 250, in between the shingles 250, or elsewhere. By including the devices 260 in the roof panel 220, the installation of, e.g., rooftop solar panels can be performed at the off-site fabrication stage instead of on-site and on the roof. It will be appreciated that in some embodiments, the roof panel 220 omits the devices 260.

Figure 3A:
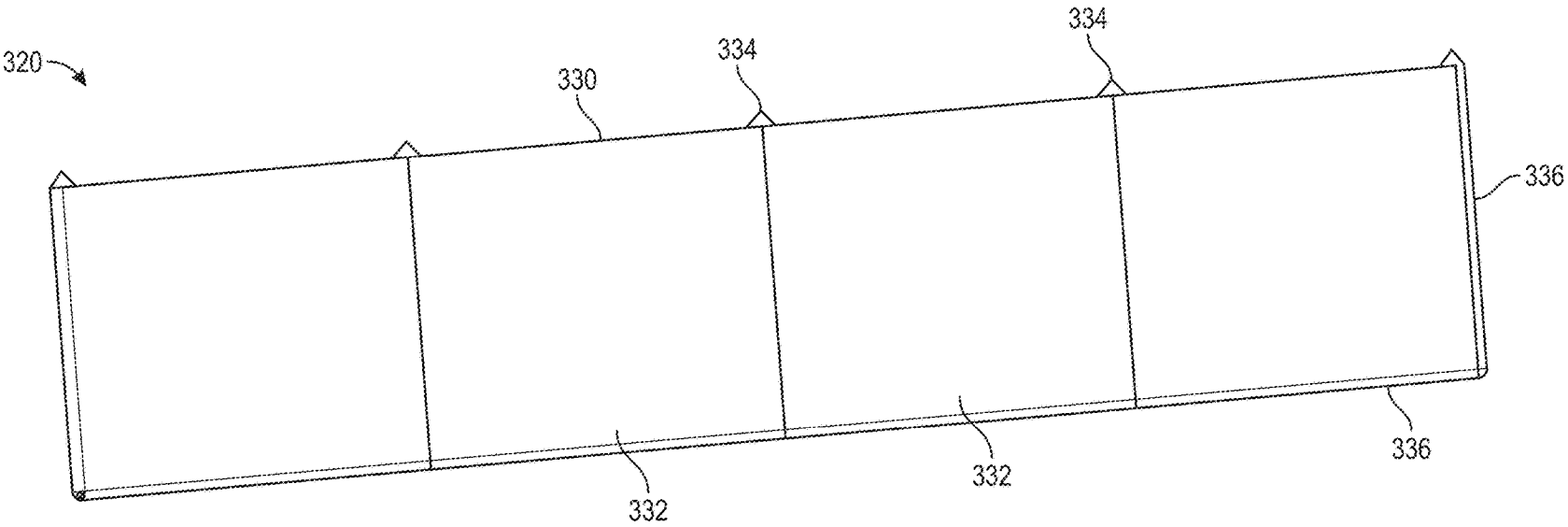
FIGS. 3A and 3B are front and rear perspective views, respectively, of a first layer of an eave roof panel, configured in accordance with embodiments of the present technology.
Figure 3B:
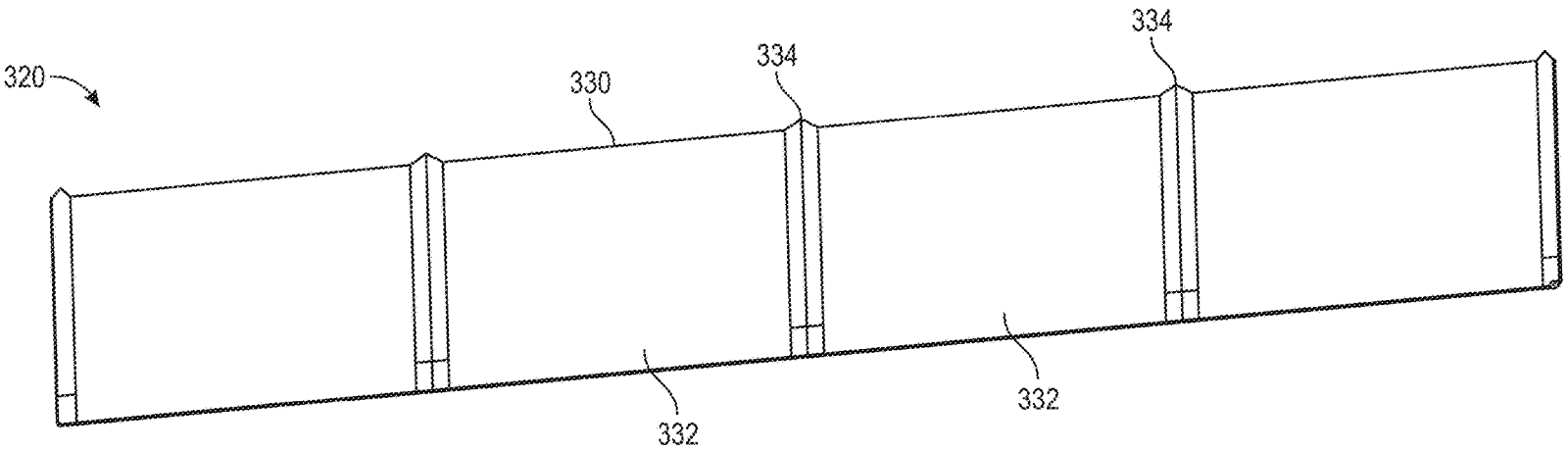

FIGS. 3A and 3B are front and rear perspective views, respectively, of a first layer 330 of an cave roof panel 320, configured in accordance with embodiments of the present technology. An cave roof panel is designed to be placed on and/or along the cave of a roof. The cave roof panel 320 can be an example of the roof panel 220 of FIG. 2, and similarly numbered components can be identical or generally similar in structure and/or function. Referring to FIGS. 3A and 3B together, the first layer 330 of the cave roof panel 320 can include a plurality of boards 332 stacked laterally, a plurality of splice plates 334, and flashings and/or drip edges 336. The boards 332 can comprise plywood boards. The splice plates 334 can comprise strips of sheet metal disposed on the front and/or rear sides of the boards 332 and extending vertically (e.g., parallel to the interfacing sides of the boards 332).

Two splice plates 334 can be coupled to the exposed side edges of the leftmost and rightmost boards 332. The remaining splice plates 334 can each be coupled to two adjacent boards 332, thereby coupling them together. The splice plates 334 can be coupled to the boards 332 via fasteners, adhesives, and/or other suitable coupling mechanisms. Also, in the illustrated embodiment, each splice plate 334 includes a tip portion extending beyond the boards 332, and the tip portion can include a feature (e.g., a hole sized to receive wire) for lifting the cave roof panel 320.

The flashings and/or drip edges 336 can protect the roof and the underlying structure from water infiltration and damage due to water running over the edges of the cave roof panel 320. Because the cave roof panel 320 is to be placed on and/or along the cave of a roof, the flashings and/or drip edges 336 can be positioned on the front side of the boards 332 and along the side and bottom edges thereof, as shown in FIG. 3A. Also, the flashings and/or drip edges 336 can be sized to match the lengths of the boards 332 on which they are positioned. In some embodiments, the flashings and/or drip edges 336 are positioned to overhang the boards 332 to properly cover the fascia board, which may be installed on-site. In some embodiments, the fascia board is included in the cave roof panel 320 at the off-site prefabrication stage.

Figure 4:
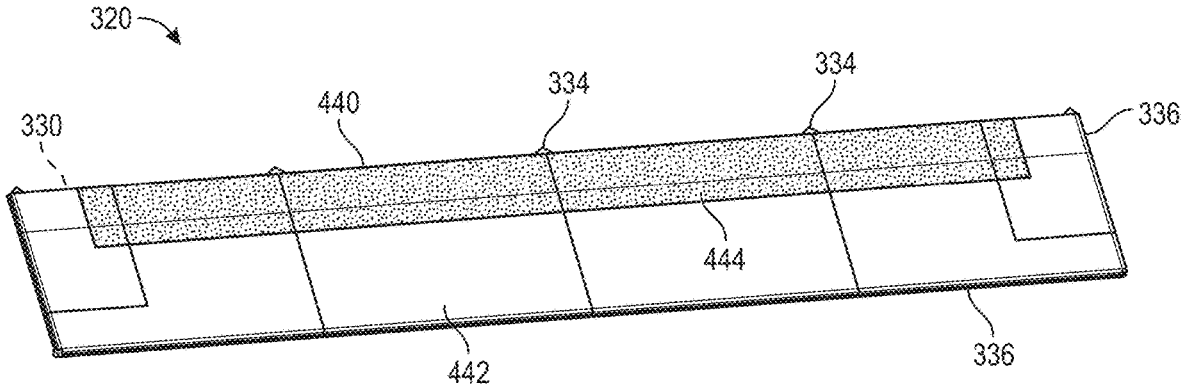
FIG. 4 is a front perspective view of the eave roof panel of FIG. 3A further including a second layer, configured in accordance with embodiments of the present technology.

FIG. 4 is a front perspective view of the cave roof panel 320 further including a second layer 440, configured in accordance with embodiments of the present technology. The second layer 440 can include an IWS 442 and an underlayment 444. The IWS 442 and/or the underlayment 444 can each comprise one or more layers that are disposed over the first layer 330 (obscured in FIG. 4) in an overlapping or non-overlapping arrangement. In the illustrated embodiment, the IWS 442 is positioned along the left side, the right side, and the bottom edge of the cave roof panel 320. In particular, the IWS 442 is disposed along the flashings and/or the drip edges 336. Therefore, when the cave roof panel 320 is installed on a roof, the IWS 442 can be positioned along the periphery of the roof. The underlayment 444 can be positioned to cover the portions of the first layer 330 not covered by the IWS 442. The interface between the IWS 442 and the underlayment 444 can be watertight to prevent water damage to the first layer 330 underneath.

Figure 5:
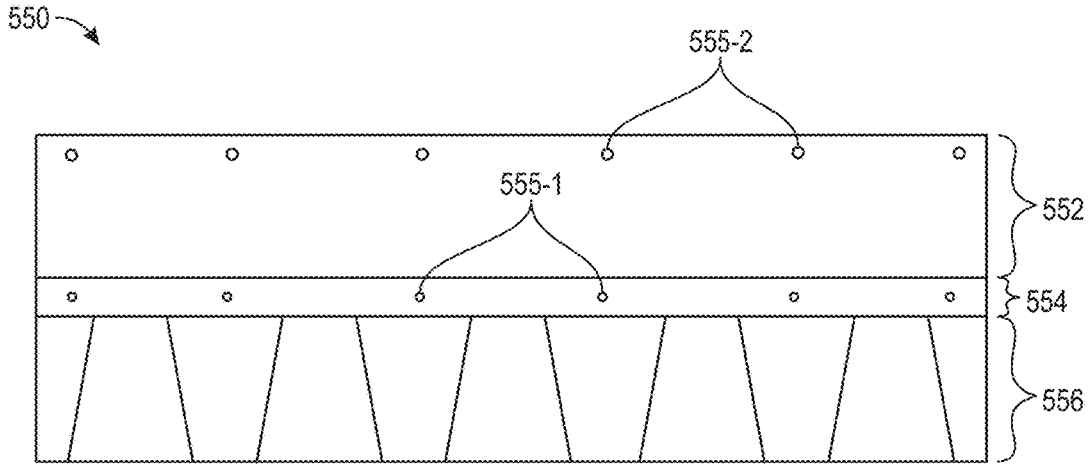
FIG. 5 is a front view of a shingle, configured in accordance with embodiments of the present technology.

FIG. 5 is a front view of a shingle 550, configured in accordance with embodiments of the present technology. The shingle 550 can comprise a singular, integrated shingle made of asphalt, fiberglass matt, composites thereof, and/or other suitable materials for providing protection against the elements. The shingle 550 can include a top portion 552, a middle portion 554, and a bottom portion 556. When the shingle 550 is stacked with other shingles 550, as discussed further herein, the top portion 552 and/or the middle portion 554 can be covered by other shingles, and the bottom portion 556 can be exposed. In some embodiments, the bottom portion 556 includes patterning for aesthetic purposes (e.g., to resemble a collection of smaller shingles).

To assemble multiple shingles 550 at the off-site prefabrication stage, a first row of nails 555-1 (or other fasteners) can be driven through the middle portion 554 of the illustrated shingle 550, the second layer 440, and the first layer 330. Then, another shingle (not shown in FIG. 5) can be placed on and partially overlapping with the illustrated shingle 550, and a second row of nails 555-2 can be driven through the middle portion of the other shingle and the top portion 552 (e.g., adjacent the top edge) of the illustrated shingle 550 (and other layers of both shingles, such as the second layer 440 and the first layer 330). As discussed further herein with reference to FIGS. 18A-18C, for at least some of the shingles 550, each of the nails 555-1, 555-2 (collectively referred to as "the nails 555") can be driven through (i) two shingles 550 in adjacent rows that are partially overlapping, (ii) the second layer 440 of each of the two shingles, and (iii) the first layer 330 of each of the two shingles, and can be covered on top by a third shingle 550.

Figure 6:
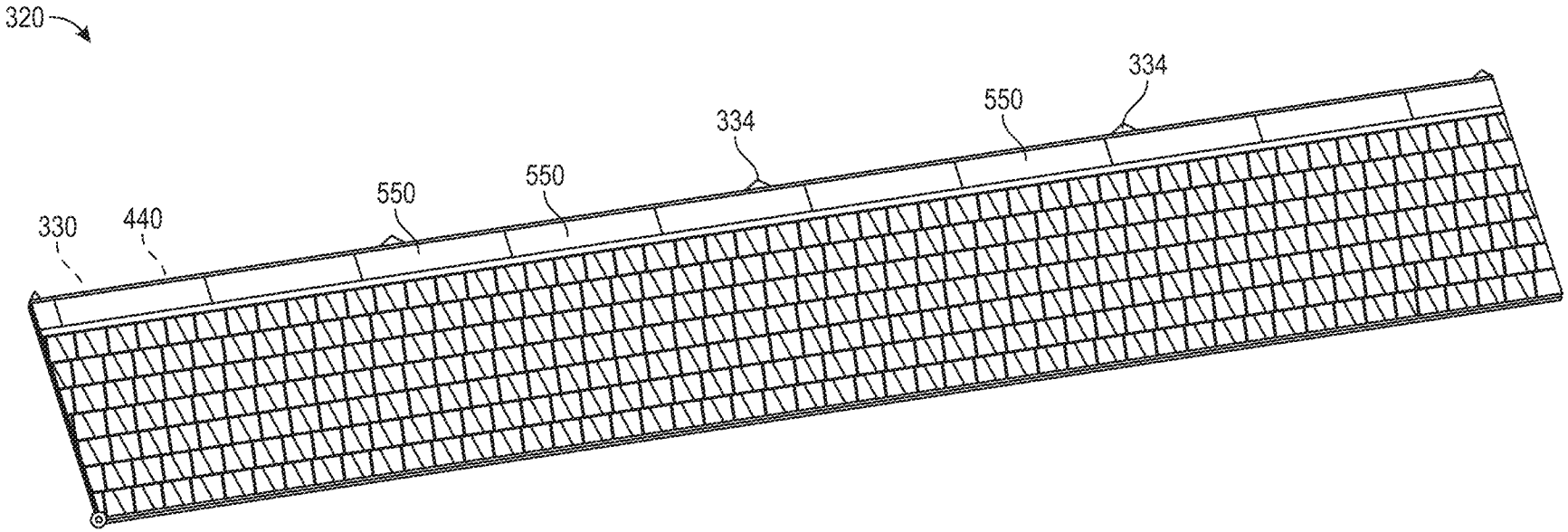
FIG. 6 is a front perspective view of the eave roof panel of FIG. 3A further including multiple ones of the shingle of FIG. 5.

FIG. 6 is a front perspective view of the cave roof panel 320 further including a plurality of the shingles 550. As previously mentioned, the nails 555 (FIG. 5) or other fasteners can be used to attach the shingles 550 to the first layer 330, the second layer 440, and/or adjacent shingles 550. As shown, the cave roof panel 320 can include the plurality of shingles 550 arranged in rows and columns. In some embodiments, the rows are spaced apart by the height of the third portion 556 (FIG. 5) such that shingles in adjacent rows partially overlap and only the third portion 556 of each shingle 550 (other than the shingles 550 on the topmost row) is exposed. Shingles in adjacent columns can be stacked laterally in a non-overlapping arrangement. In some embodiments, the columns are staggered such that the side edges of overlapping shingles in adjacent rows are not aligned, as better illustrated in FIG. 10.

The shingles 550 can be arranged as discussed above and the nails 555 can be applied during fabrication of the cave roof panel 320. For example, all of the shingles 550, except for those at the topmost row, can have both the first and second rows of nails 555 driven therethrough, as shown in FIG. 5, at the off-site factory or other prefabrication location. The topmost row of shingles 550 can have the second row of nails 555 driven therethrough, thus can still be coupled to the rest of the cave roof panel 320. Therefore, the manual labor of applying the nails 555 on-site can be significantly reduced.

Figure 7A:
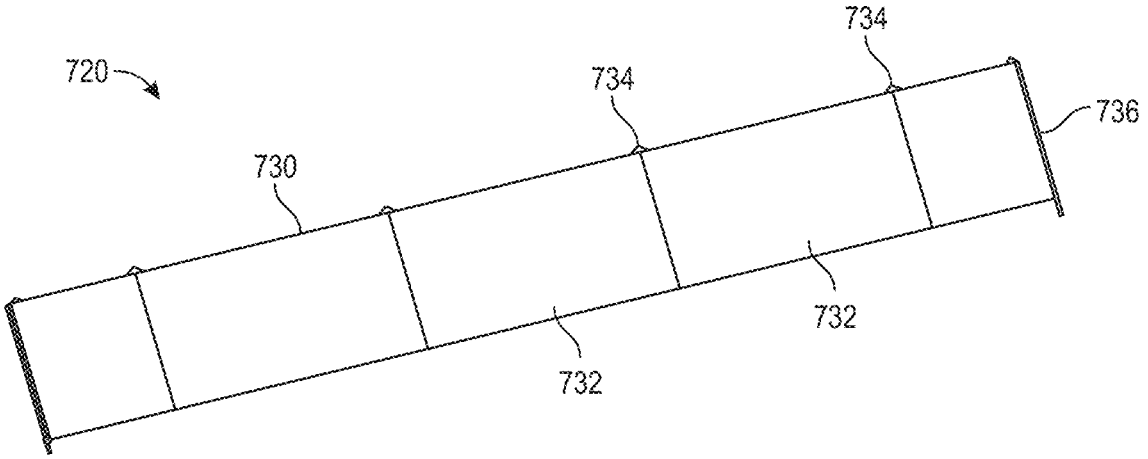
FIGS. 7A and 7B are front perspective and rear views, respectively, of a first layer of a subsequent roof panel, configured in accordance with embodiments of the present technology.
Figure 7B:
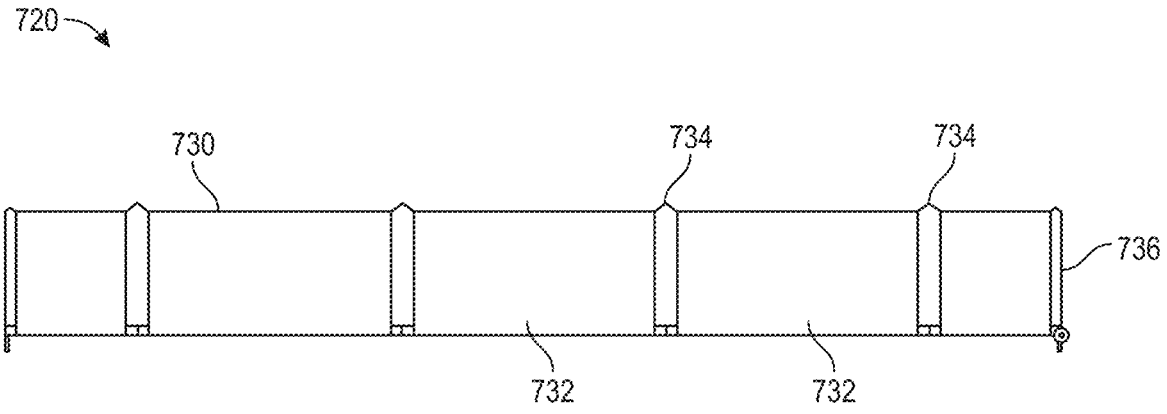

FIGS. 7A and 7B are front perspective and rear views, respectively, of a first layer 730 of a subsequent roof panel 720, configured in accordance with embodiments of the present technology. A subsequent roof panel is designed to be stacked above an cave roof panel (e.g., the cave roof panel 320 of FIGS. 3A-6) or another subsequent roof panel along a roof. The subsequent roof panel 720 can be an example of the roof panel 220 of FIG. 2, and similarly numbered components can be identical or generally similar in structure and/or function. Referring to FIGS. 7A and 7B together, the first layer 730 of the subsequent roof panel 720 can include a plurality of boards 732 stacked laterally, a plurality of splice plates 734, and flashings and/or drip edges 736. The boards 732 can comprise plywood boards. The splice plates 734 can comprise strips of sheet metal disposed on the front and/or rear sides of the boards 732 and extending vertically (e.g., parallel to the interfacing sides of the boards 732).

Two splice plates 734 can be coupled to the exposed side edges of the leftmost and rightmost boards 732. The remaining splice plates 734 can each be coupled to two adjacent boards 732, thereby coupling them together. The splice plates 734 can be coupled to the boards 732 via fasteners, adhesives, and/or other suitable coupling mechanisms. Also, in the illustrated embodiment, each splice plate 734 includes a tip portion extending beyond the boards 732, and the tip portion can include a feature (e.g., a hole sized to receive a lifting eye, a hook, a shackle, etc.) for lifting the cave roof panel 720. The flashings and/or drip edges 736 can protect the roof and the underlying structure from water infiltration and damage due to water running over the edges of the subsequent roof panel 720.

The first layer 330 of the cave roof panel 320 (FIGS. 3A and 3B) and the first layer 730 of the subsequent roof panel 720 can have three important differences. First, because the subsequent roof panel 720 is designed to be placed above an cave roof panel or another subsequent roof panel, the subsequent roof panel 720 may only include the flashings and/or drip edges 736 on the left and right sides of the boards 732, and not on the bottom edge thereof. Second, the flashings and/or drip edges 736 on the left and right sides extend past the bottom edge of the boards 732 to overlap with the panel (an cave roof panel or another subsequent roof panel) below. The flashings and/or drip edges 736 can extend past the bottom edge of the boards 732 by a distance between 3-9 inches, such as 6 inches. Third, the boards 732 can be sized such that the boundaries of adjacent boards 732 do not align with the boundaries of adjacent boards of the panel below or above. For example, the boundaries of adjacent boards 732 are arranged such that when the subsequent roof panel 720 is stacked above the cave roof panel 320 (FIGS. 3A and 3B), the boundaries of adjacent boards 732 are generally aligned with the center of each of the boards 332, and not the boundaries of adjacent boards 332. In some embodiments, however, the boundaries of adjacent boards 732 can be aligned with the boundaries of adjacent boards 332.

Figure 8:
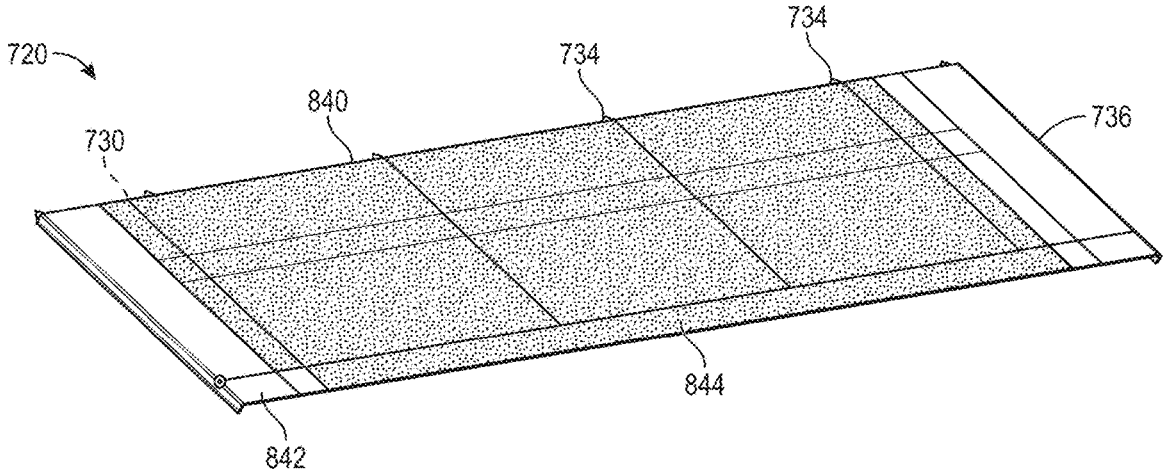
FIG. 8 is a front perspective view of the subsequent roof panel of FIG. 7A further including a second layer, configured in accordance with embodiments of the present technology.

FIG. 8 is a front perspective view of the subsequent roof panel 720 further including a second layer 840, configured in accordance with embodiments of the present technology. The second layer 840 can include an ice and water shield (IWS) 842 and an underlayment 844. The IWS 842 and/or the underlayment 844 can each comprise one or more layers that are disposed over the first layer 730 (obscured in FIG. 8) in an overlapping or non-overlapping arrangement. In the illustrated embodiment, the IWS 842 is positioned along the left and right sides of the subsequent roof panel 720. In particular, the IWS 842 is disposed along the flashings and/or the drip edges 736. Therefore, when the subsequent roof panel 720 is installed on a roof, the IWS 842 can be positioned along the periphery of the roof. The underlayment 844 can be positioned to cover the portions of the first layer 730 not covered by the IWS 842. The interface between the IWS 842 and the underlayment 844 can be watertight to prevent water damage to the first layer 730 underneath.

Figure 9:
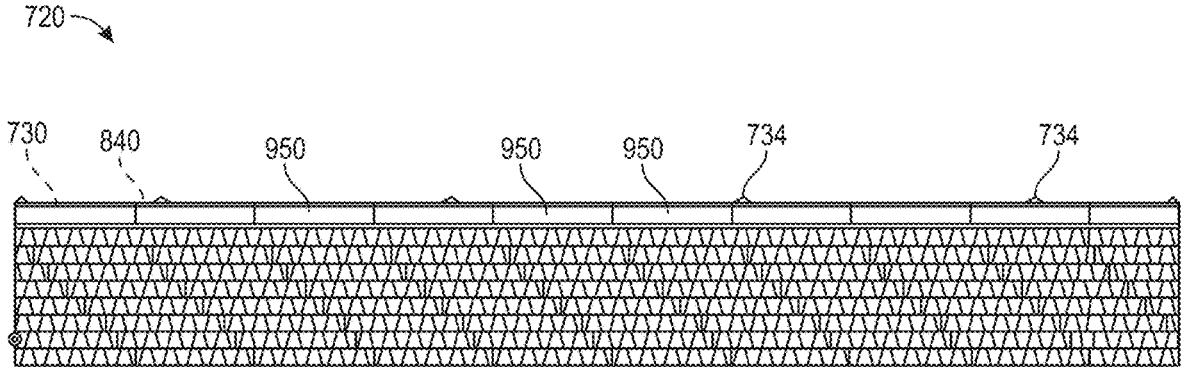
FIG. 9 is a front view of the subsequent roof panel of FIG. 7A further including a plurality of shingles, configured in accordance with embodiments of the present technology.

FIG. 9 is a front view of the subsequent roof panel 720 further including a plurality of shingles 950, configured in accordance with embodiments of the present technology. Each of the shingles 950 can be identical or generally similar to the shingle 550 of FIG. 5. Also, like the cave roof panel 320, the subsequent roof panel 720 can include nails or other fasteners for attaching the shingles 950 onto the first layer 730 and the second layer 840. Furthermore, the shingles 950 can be arranged in rows and columns as discussed above with respect to the shingles 550 and with reference to FIGS. 5 and 6.

Figure 10:
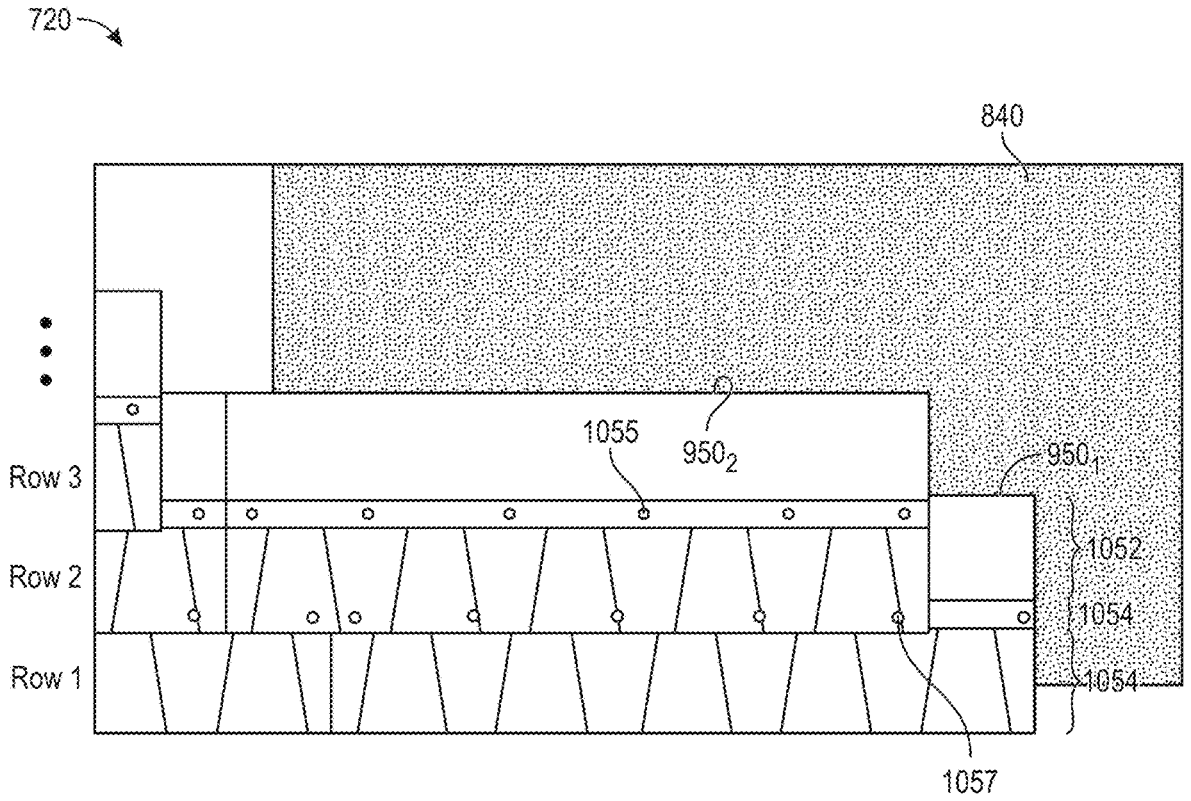
FIG. 10 is a front view of a portion of the subsequent roof panel of FIG. 7A illustrating construction thereof in accordance with embodiments of the present technology.

FIG. 10 is a front view of a portion of the subsequent roof panel 720 illustrating construction thereof in accordance with embodiments of the present technology. Each shingle 950 can include a top portion 1052, a middle portion 1054, and a bottom portion 1056. As shown, the shingles 950 can be arranged in rows (e.g., Row 1, Row 2, Row 3, etc.) and staggered columns such that, except for the shingles in Row 1 ("the shingles $\mathbf{950}_1$"), the middle portion 1054 and bottom portion 1056 of each shingle 950 at least partially cover the top portion 1054 and the middle portion 1056 of one or more shingles 950 in the row immediately below. Also, the shingles 950 can be coupled to the first layer 730 (obscured from view in FIG. 10) and the second layer 840 via nails 1055. In particular, when the subsequent roof panel 720 is fabricated off-site, for shingles in Row 2 ("the shingles $\mathbf{950}_2$") and above, a first row of nails 1055 through the top portion 1052 and a second row of nails 1055 through the middle portion 1054 couple each shingle 950 to the first layer 730 and the second layer 840. The shingles $\mathbf{950}_1$, however, may be coupled to the first layer 730 and the second layer 840 via only a single row of nails 1055 that go through the top portion 1052. In other words, at the off-site prefabrication stage, nails may not be driven through the middle portion 1054 of the shingles $\mathbf{950}_1$.

Furthermore, like for the cave roof panel 320, the topmost row of shingles 950 can have the second row of nails 1055 through the middle portions 1054 thereof, and thus coupled to the first layer 730 and the second layer 840, but not the first row of nails 1055 through the top portions 1052 thereof. Therefore, in some embodiments, the subsequent roof panel 720 is fabricated as described above, and once transported to an on-site location and placed on a roof, nails can be applied (i) at spots 1057, which are illustrated by circles in FIG. 10, and (ii) at the top portions 1052 of the topmost rows of shingles 950. As discussed in further detail below with reference to FIGS. 18A-18C, the absence of nails on (i) the middle portions 1054 of the shingles $950_1$ and (ii) the top portions 1052 of the topmost row of shingles 950 can facilitate coupling of roof panels in adjacent rows.

Figure 11A:
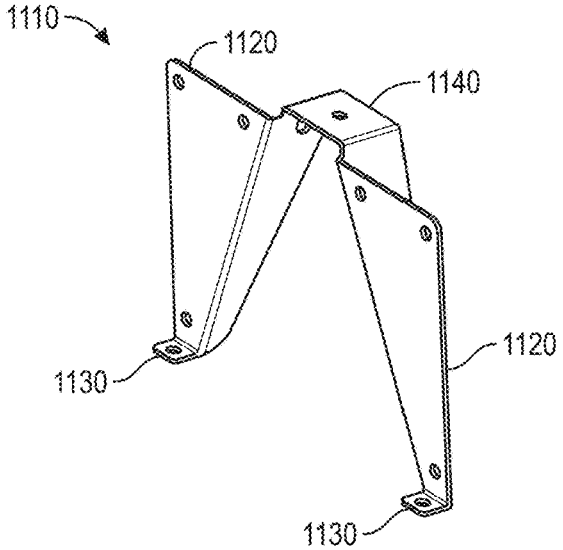
FIGS. 11A-11C are perspective views of a bracket, configured in accordance with embodiments of the present technology.
Figure 11B:
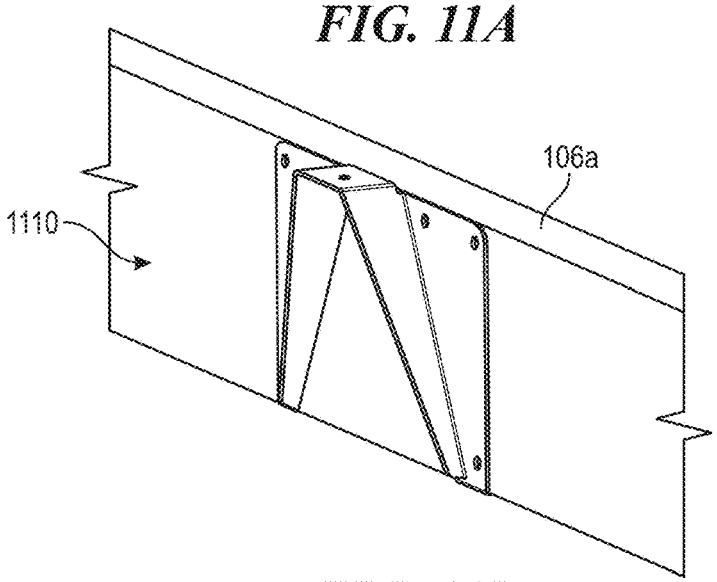
Figure 11C:
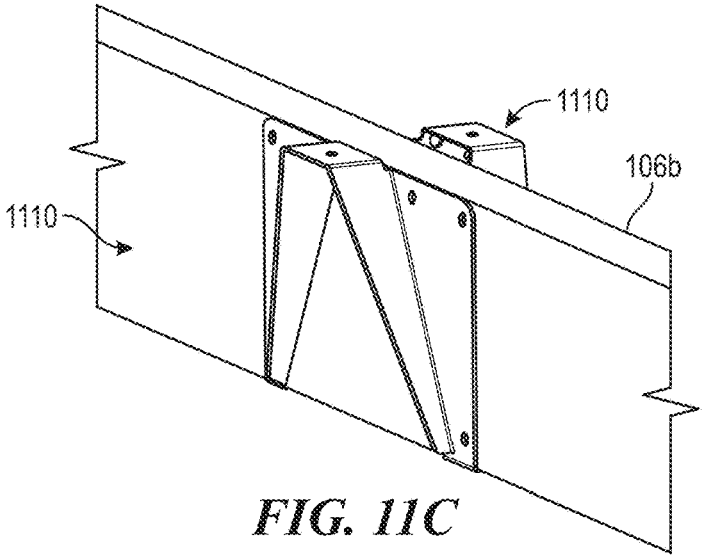

FIGS. 11A-11C are perspective views of a bracket 1110, configured in accordance with embodiments of the present technology. The bracket 1110 can be an example of the bracket 110 of FIG. 1. Referring first to FIG. 11A, the bracket 1110 can include a pair of wing portions 1120, a pair of lip portions 1130 extending from corresponding ones of the wing portions 1120, and an interfacing portion 1140 coupled between the wing portions 1120. Each of the portions 1120, 1130, 1140 can include a generally flat surface with one or more apertures for receiving fasteners (e.g., nails, screws, bolts, and/or the like). In particular, the two wing portions 1120 can generally lie on the same plane as one another, and the two lip portions 1130 can generally lie on the same plane as one another. Each of the lip portions 1130 and the interfacing portion 1140 can extend generally perpendicular to the wing portions 1120. FIGS. 11B and 11C illustrate one or more of the brackets 1110 coupled to an edge rafter 106*a* and a middle rafter 106*b*, respectively. The edge rafter 106*a* can be a rafter at an edge of a roof and defining a boundary thereof. The middle rafter 106*b* can be a rafter between edge rafters 106*a* and at the inner region of a roof.

Referring next to FIG. 11B, the bracket 1110 can be coupled to the edge rafter 106*a*. In particular, the wing portions 1120 can be coupled (e.g., via fasteners) to a side surface of the edge rafter 106*a* and the lip portions 1130 can be coupled (e.g., via fasteners) to a bottom surface of the edge rafter 106*a*. The interfacing portion 1140 may not be coupled to the edge rafter 106*a*, but instead exposed to be subsequently coupled (e.g., via fasteners) to a roof panel. Because the edge rafter 106*a* may define a boundary of a roof and a roof panel may be positioned to not extend past the edge rafter 106*a*, in some embodiments and as shown, a plurality of the brackets 1110 is attached to a single side surface of the edge rafter 106*a* and along its length.

Referring next to FIG. 11C, the bracket 1110 can be coupled to the middle rafter 106*b* in the same manner as discussed above with respect to the edge rafter 106*a*. However, the middle rafter 106*b* does not define a boundary of a roof and a roof panel may be positioned to extend across the middle rafter 106*b* in both directions. Therefore, in some embodiments and as shown, a plurality of the brackets 1110 is attached to both side surfaces of the middle rafter 106*b* and along its length.

Figure 12B:
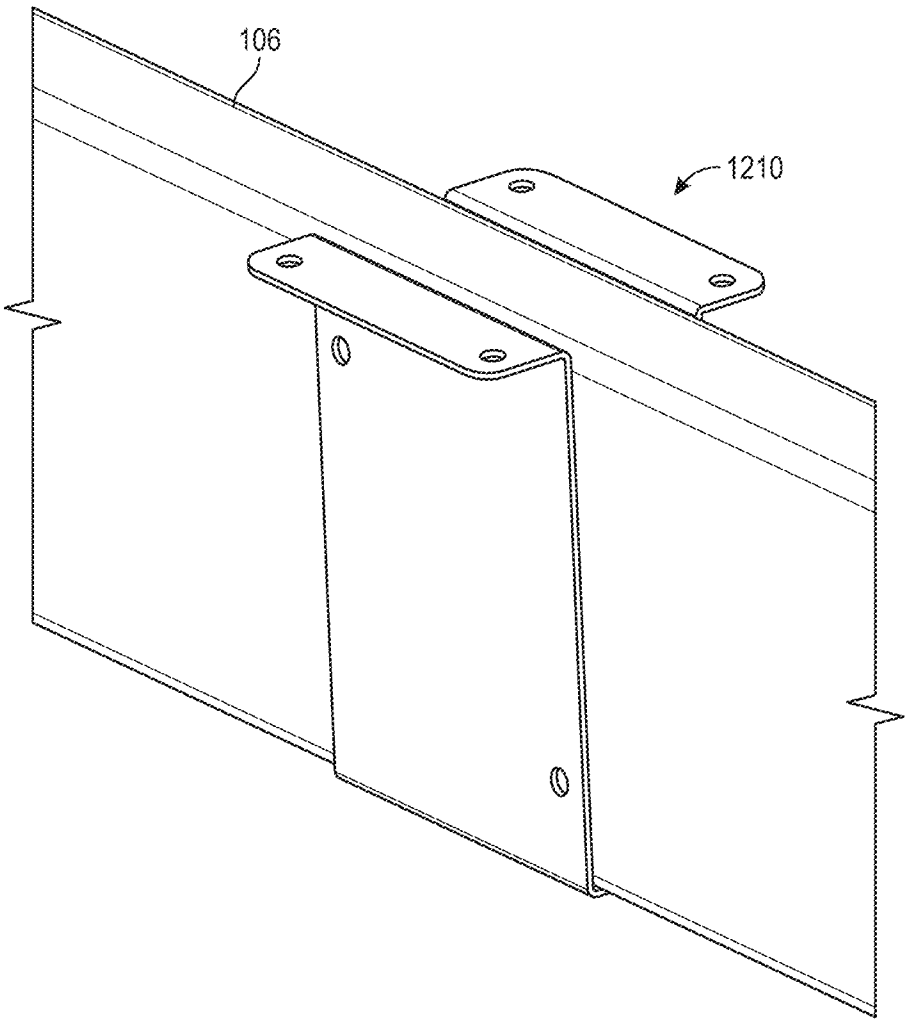
FIGS. 12A and 12B are perspective views of another bracket, configured in accordance with embodiments of the present technology.
Figure 12A:
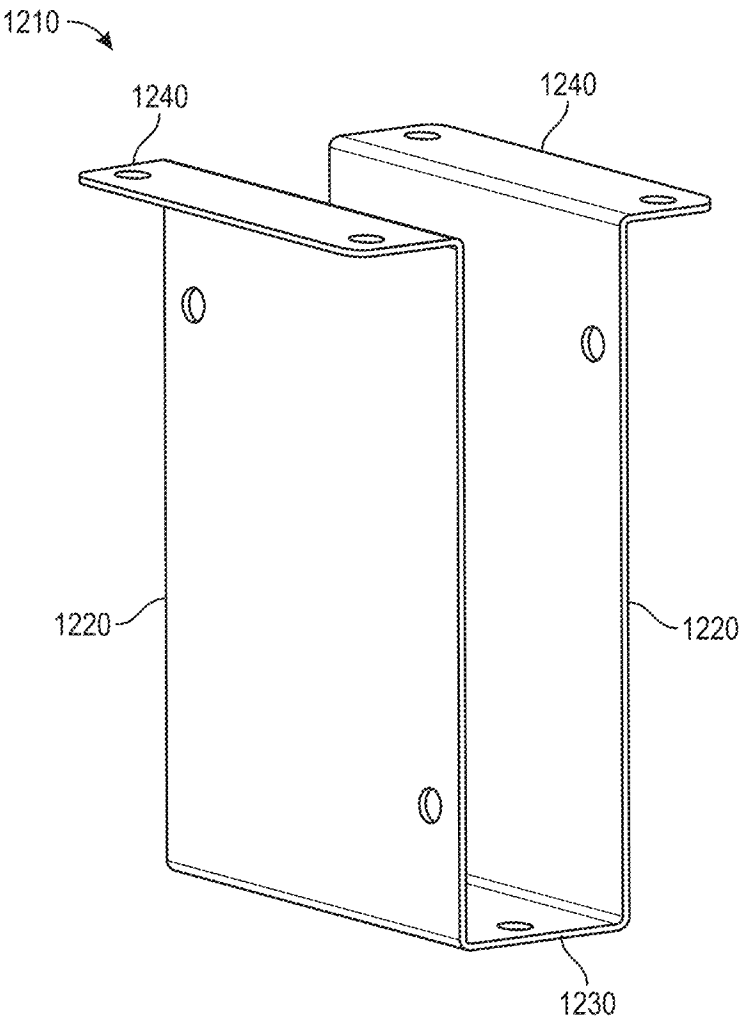

FIGS. 12A and 12B are perspective views of another bracket 1210, configured in accordance with embodiments of the present technology. The bracket 1210 can be an example of the bracket 110 of FIG. 1. Referring first to FIG. 12A, the bracket 1210 can include a pair of wing portions 1220, a base portion 1230 coupled between the wing portions 1220, and a pair of interfacing portions 1240 coupled to corresponding ones of the wing portions 1220. Each of the portions 1220, 1230, 1240 can include a generally flat surface with one or more apertures for receiving fasteners (e.g., nails, screws, bolts, and/or the like). The two wing portions 1220 can be spaced apart and generally parallel to one another. The base portion 1230 can be oriented generally perpendicular to the wing portions 1220 and extending therebetween. The two interfacing portions 1240 can be oriented generally perpendicular to the wing portions 1220 and parallel to the base portion 1230, and extending outward (e.g., away from a midplane of the bracket 1210).

Referring next to FIG. 12B, the bracket 1210 can be coupled to the rafter 106. In particular, the base portion 1230 is sized to correspond to the thickness of the rafter 106 such that the two wing portions 1220 extend along the two side surfaces of the rafter 106, respectively. The wing portions 1220 and the base portion 1230 can be coupled (e.g., via fasteners) to the rafter 106. The interfacing portion 1240 may not be coupled to the rafter 106, but instead exposed to be subsequently coupled (e.g., via fasteners) to a roof panel. As shown, a single one of the bracket 1210 can be coupled to a roof panel on both sides of the rafter 106.

Figure 13:
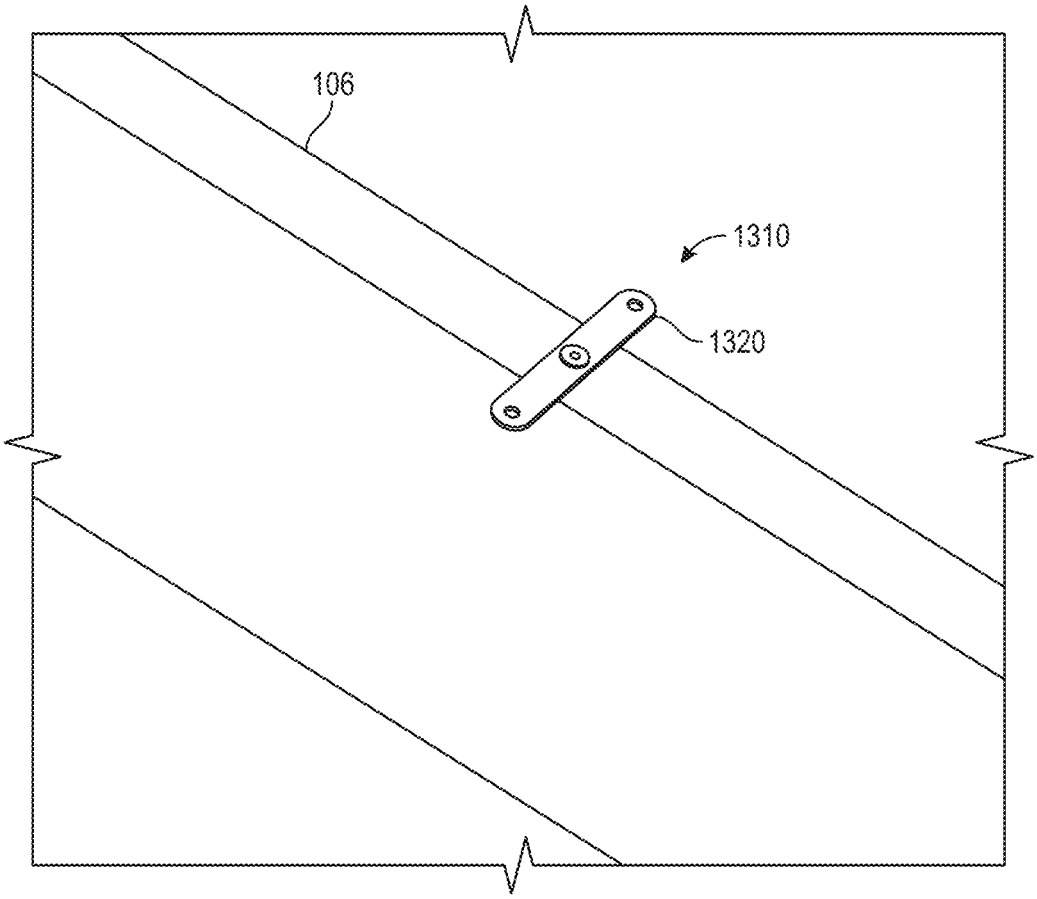
FIG. 13 is a perspective view of yet another bracket, configured in accordance with embodiments of the present technology.

FIG. 13 is a perspective view of yet another bracket 1310, configured in accordance with embodiments of the present technology. The bracket 1310 can be an example of the bracket 110 of FIG. 1. The bracket 1310 can include a flat and elongate member 1320 with three apertures linearly aligned along the length of the member 1320. As shown, the middle aperture can be coupled (e.g., via fasteners) to a top surface of the rafter 106, leaving the two other apertures on either side of the middle aperture to be coupled (e.g., via fasteners) to a roof panel.

Referring to FIGS. 11A-13 together, each of the brackets 1110, 1210, 1310 can be made of metal (e.g., aluminum, steel, titanium) and/or other suitable materials. Also, although each of FIGS. 11B, 11C, 12B, and 13 illustrates a single bracket coupled to a rafter, multiple brackets can be coupled along the length of the rafter. It is appreciated that the brackets 1110, 1210, 1310 are merely examples, and that other bracket configurations, including blockings illustrated in and described below with reference to FIGS. 27-31, can be employed to couple roof panels to rafters in accordance with embodiments of the present technology.

III. Methods of Installing Roof Panels

FIGS. 14-20 illustrate a series of steps (e.g., a method or process) for attaching roof panels to a roof. While FIGS. 14-20 and the corresponding steps are presented in a particular order, one or more of the steps can be performed in a different order or omitted, and the method can include additional and/or alternative steps. Additionally, although the method may be described below with reference to the embodiments of the roof panels and brackets described herein, the method can be performed with other embodiments of the present technology.

Figure 14:
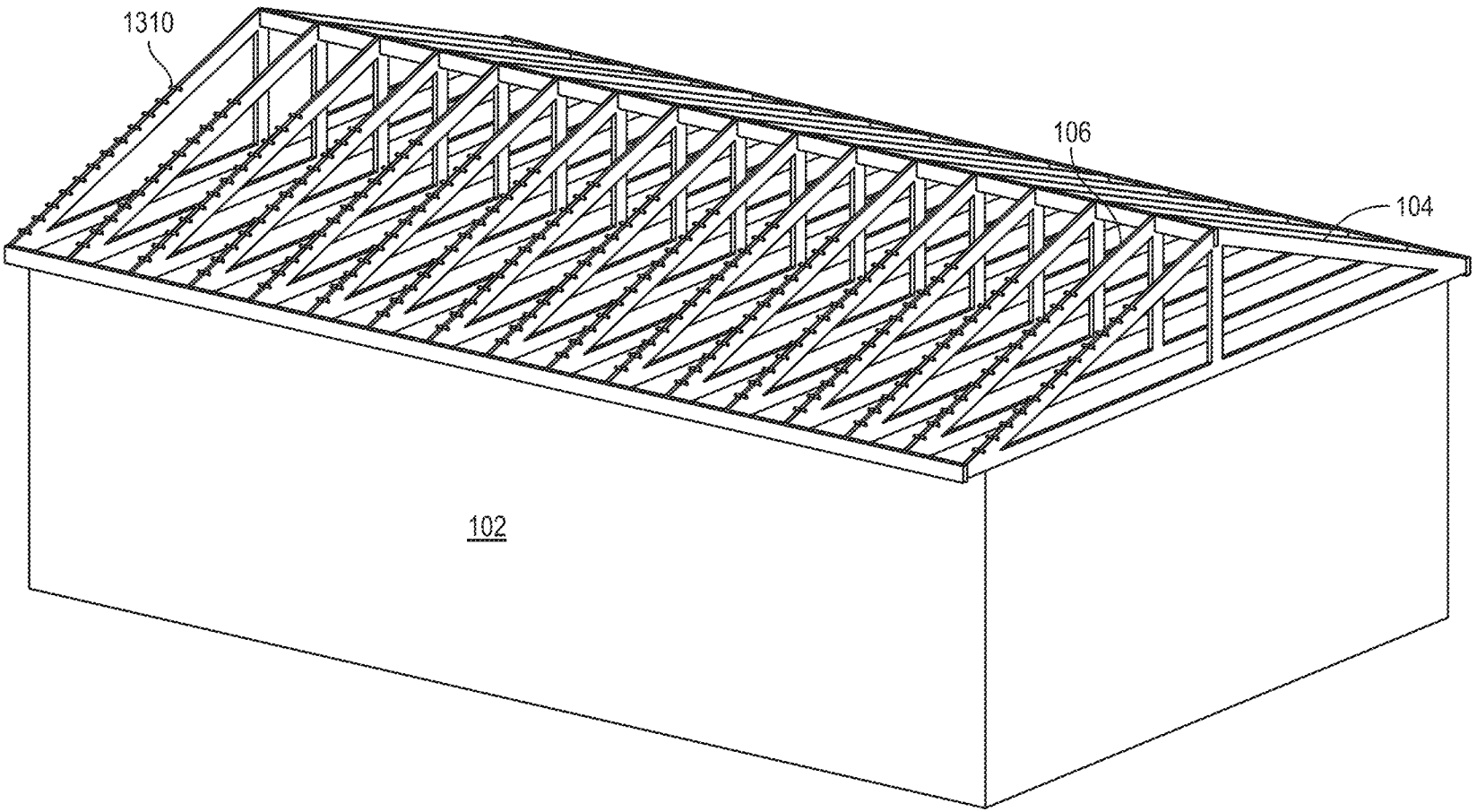
FIG. 14 illustrates installation of brackets on a roof, configured in accordance with embodiments of the present technology.

FIG. 14 illustrates installation of the brackets 1310 on a roof 104, configured in accordance with embodiments of the present technology. While the brackets 1310 are illustrated, the bracket 1110, the bracket 1210, and/or other brackets can be used in addition to and/or in place of the illustrated brackets 1310. As shown, multiple brackets 1310 can be coupled to each rafter 106 along its length. The rafters 106 can have the same or different patterns of the brackets 1310 attached thereto. The brackets 1310 can be attached to the rafters 106 prior to or after assembly of the rafters 106 to construct the roof 104.

Figure 15:
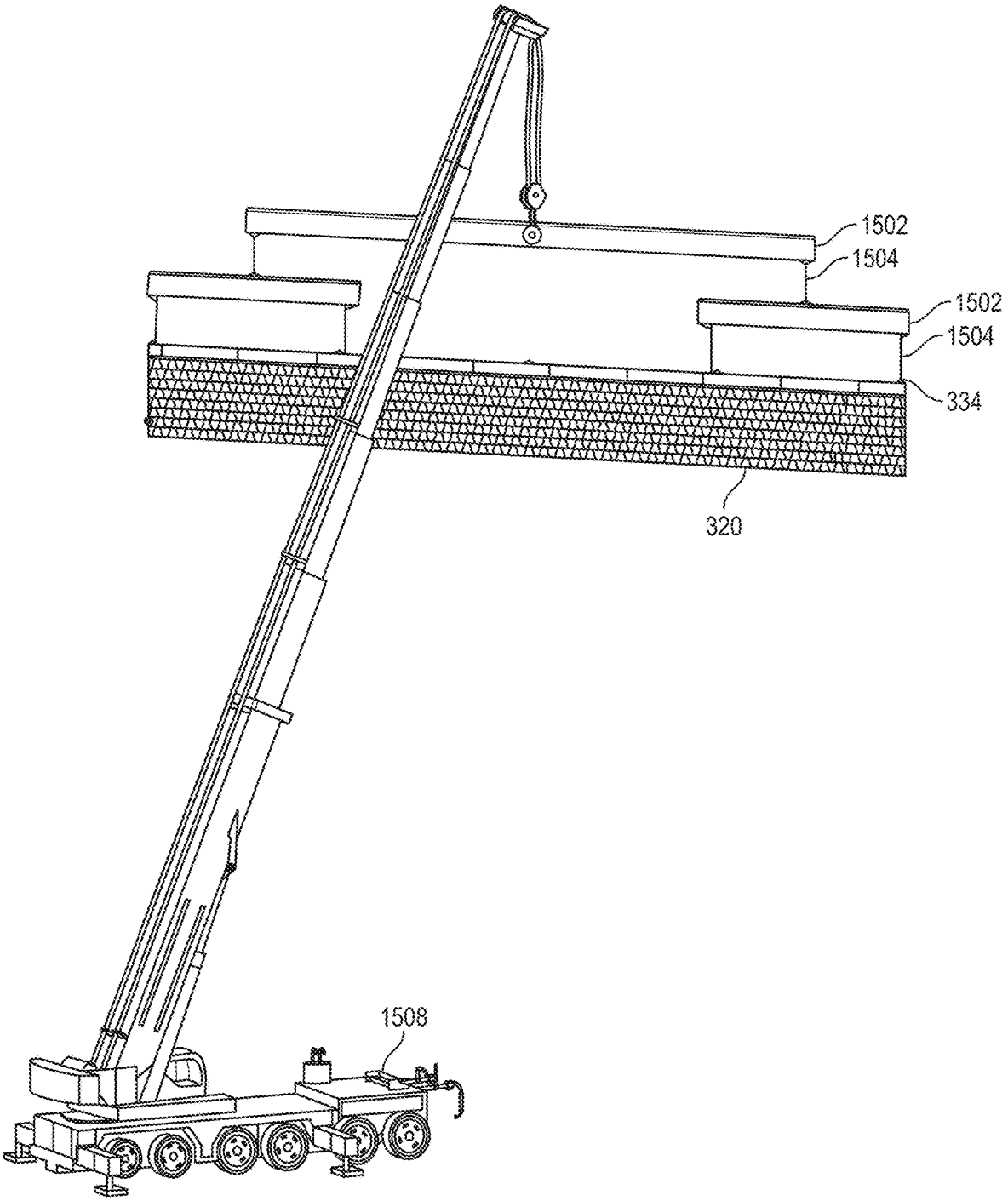
FIG. 15 illustrates on-site handling of a roof panel, configured in accordance with embodiments of the present technology.

FIG. 15 illustrates on-site handling of the cave roof panel 320, configured in accordance with embodiments of the present technology. While the cave roof panel 320 is illustrated, the subsequent roof panel 720 can be handled in a similar manner. A crane 1508 can be operated to carry or otherwise handle the cave roof panel 320 on-site. The crane 1508 can be an example of the machine 108 of FIG. 1. As shown, the crane 1508 can lift the cave roof panel 320 via one or more I-beams 1502 and one or more wires 1504. In some embodiments, the wires 1504 attach to the tips of the splice plates 334, which can each include an aperture through which the wires 1504 can be tied. The I-beams 1502 and the wires 1504 can be attached to one another and to the cave roof panel 320 off-site and/or on-site. Use of the I-beams 1502 and the wires 1504 can help distribute the pulling force of the crane 1508 on the cave roof panel 320, allowing the cave roof panel 320 to remain level during operation of the crane 1508.

Figure 16:
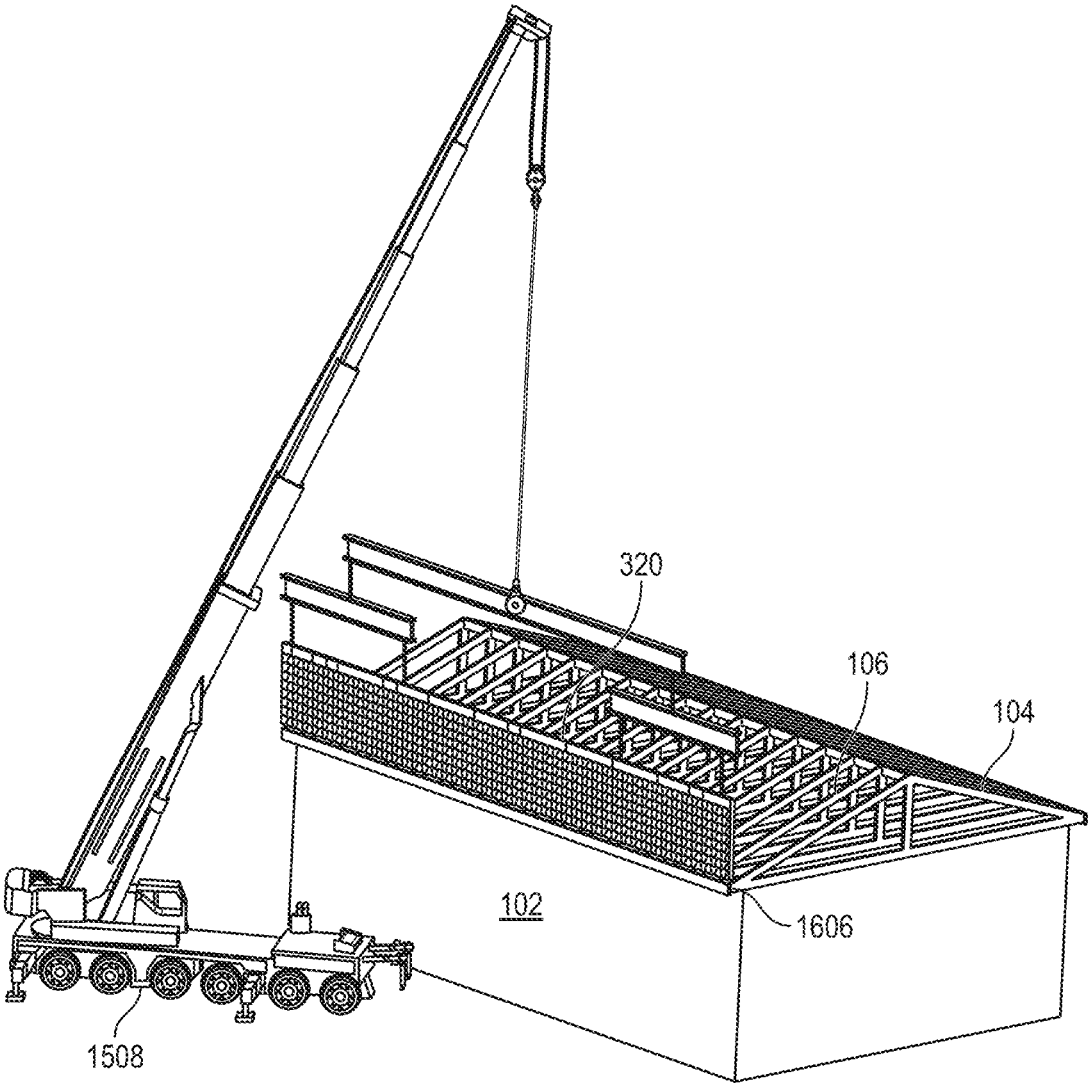
FIG. 16 illustrates on-site placement of a roof panel on a roof, configured in accordance with embodiments of the present technology.

FIG. 16 illustrates on-site placement of the cave roof panel 320 on the roof 104, configured in accordance with embodiments of the present technology. As illustrated by comparing FIGS. 15 and 16, the crane 1508 can be operated to lower the cave roof panel 320 onto the rafters 106, and more specifically, onto the cave of the roof 104. In some embodiments, the structure 102 can include a fascia 1606 along the cave of the roof 104 that the crane 1508 can use as a pivot to lower and subsequently rotate the cave roof panel 320 to lie parallel to the rafters 106.

Figure 17A:
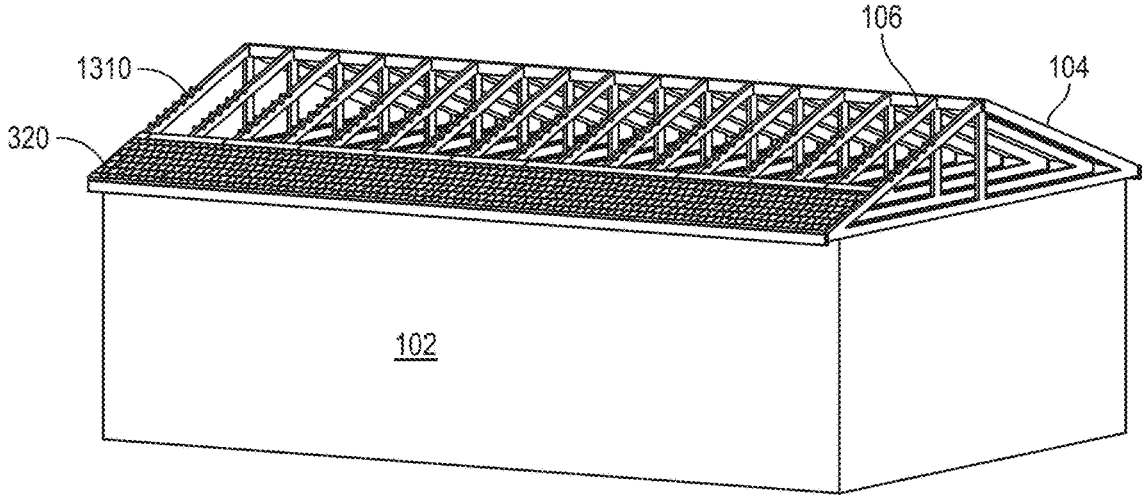
FIGS. 17A-17C illustrate attachment of a roof panel to a roof, configured in accordance with embodiments of the present technology.
Figure 17B:
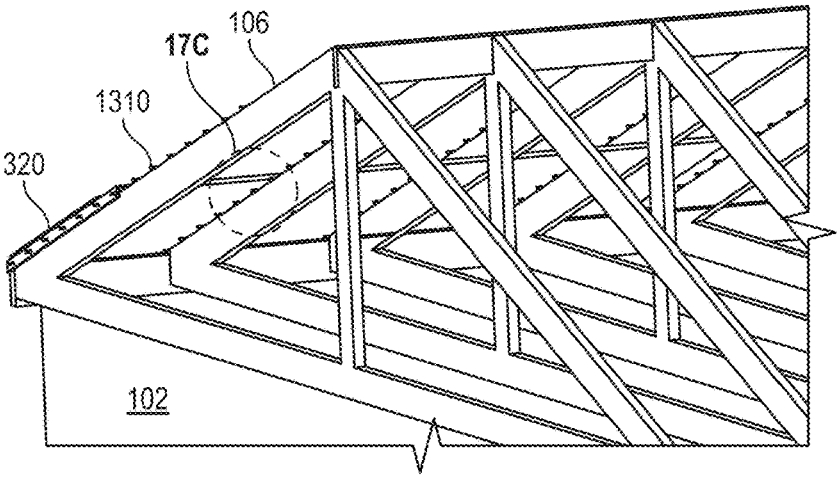
Figure 17C:
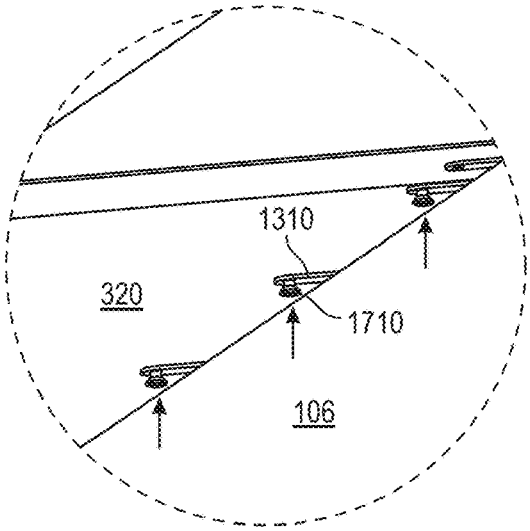

FIGS. 17A-17C illustrate attachment of the cave roof panel 320 to the roof 104, configured in accordance with embodiments of the present technology. FIG. 17A is a front perspective view of the structure 102 and the cave roof panel 320 properly placed into position on the rafters 106. FIG. 17B is an enlarged rear perspective view of the structure 102 and the cave roof panel 320, and FIG. 17C is a further enlarged rear perspective view of the cave roof panel 320 interfacing the rafters 106 (e.g., an enlarged view of the portion encircled with label "17C" in FIG. 17B). Referring to FIGS. 17B and 17C together, when the cave roof panel 320 is placed on the rafters 106, the brackets 1310 and the rear side of the cave roof panel 320 (e.g., the first layer 330 of FIGS. 3A and 3B) are accessible from the rear side of the rafters 106. Therefore, an operator or apparatus (e.g., a robot) can apply fasteners 1710 (e.g., bolts, screws, nails) through apertures of the brackets 1310 and into the cave roof panel 320 to secure the cave roof panel 320 to the rafters 106.

Once the cave roof panel 320 is installed onto the roof 104, if the roof 104 requires additional panels, one or more subsequent panes 720 can be stacked above the cave roof panel 320 or a previously installed subsequent roof panel 720. For example, the steps illustrated in FIGS. 15-17C can be repeated for the subsequent roof panels 720, but using the cave roof panel 320 or another subsequent roof panel 720 that has already been placed as the pivot.

Figure 18A:
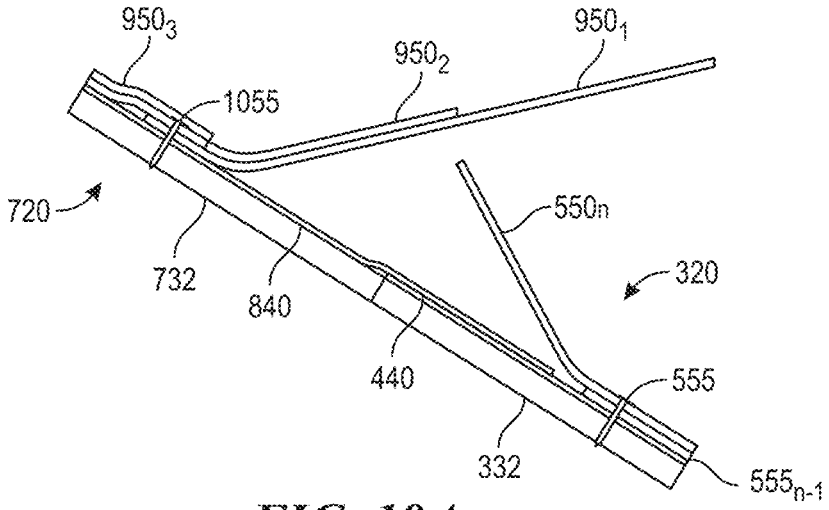
FIGS. 18A-18C illustrate attachment of adjacent roof panels, configured in accordance with embodiments of the present technology.
Figure 18B:
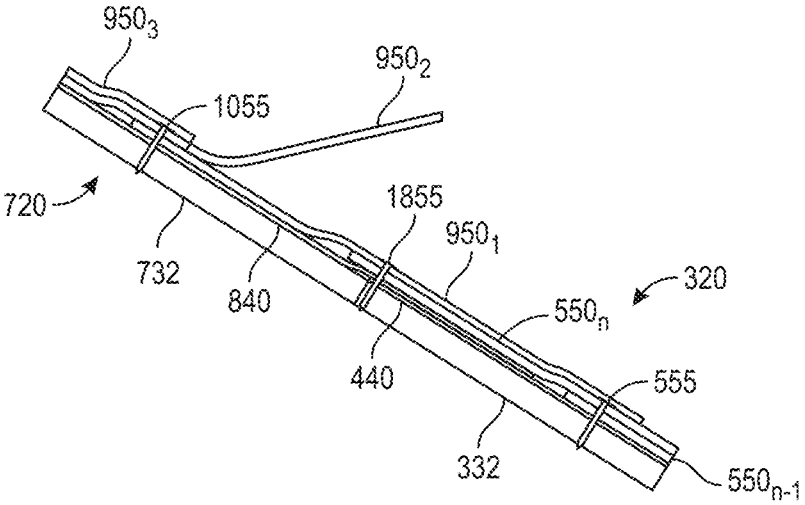
Figure 18C:
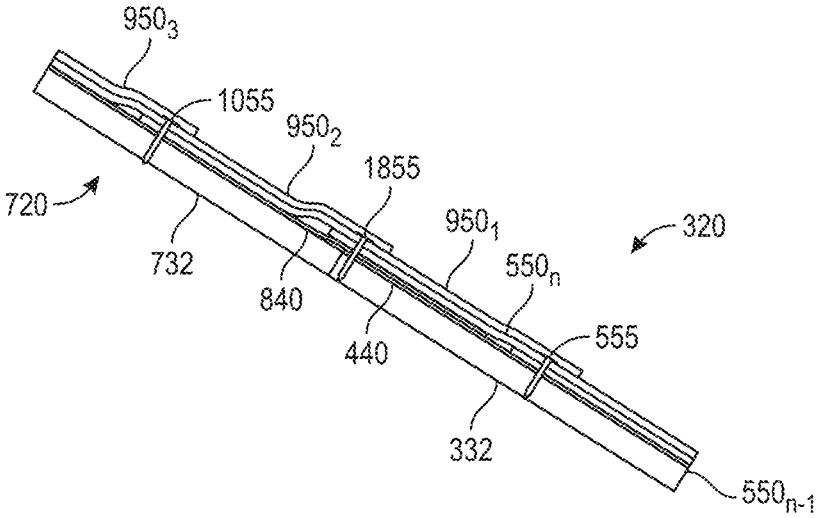

FIGS. 18A-18C illustrate attachment of adjacent roof panels, configured in accordance with embodiments of the present technology. While FIGS. 18A-18C show the cave roof panel 320 and a subsequent roof panel 720 stacked above and adjacent to the cave roof panel 320, the steps illustrated herein can apply to attaching two adjacent subsequent roof panels 720. Referring first to FIG. 18A, the boards 732 of the subsequent roof panel 720 can be stacked adjacent to (e.g., in contact with) the boards 332 of the cave roof panel 320. The boards 332, 732 can be secured to the rafters 106 (not shown in FIGS. 18A-18C) in the illustrated positions according to the steps illustrated in 17A-17C.

As discussed above with reference to FIG. 6, when prefabricated off-site, the topmost row of shingles ("the shingles $\mathbf{550}_n$") may be coupled to the boards 332 only via the second row of nails 555 through the middle portions 554 thereof. Therefore, the top portion 552 of the shingle $\mathbf{550}_n$ can be lifted up to allow the second layer 840 of the subsequent roof panel 720 (which extends past the board 732 as discussed above with reference to FIG. 8) to be placed between the second layer 440 of the cave roof panel 320 and the top portion 552 of the shingle $\mathbf{550}_n$. To allow the top portion 552 of the shingle $\mathbf{550}_n$ to be lifted, the shingles $\mathbf{950}_1$ and $\mathbf{950}_2$ can also be lifted, as shown. As discussed above with reference to FIG. 10, at the off-site prefabrication stage, the shingle $\mathbf{950}_1$ can be coupled to the board 732 only via the first row of nails 1055, allowing the shingles $\mathbf{950}_1$ and $\mathbf{950}_2$ to be lifted as illustrated. The shingles 550, 950 can be made of sufficiently flexible materials to be bent as shown without breaking.

Referring next to FIG. 18B, the shingle $\mathbf{550}_n$ can be lowered on top of the second layer 840, and the shingle $\mathbf{950}_1$ can be lowered on top of the shingle $\mathbf{550}_n$. Subsequently, a row of nails 1855 can be driven through the shingle $\mathbf{950}_1$, the shingle $\mathbf{550}_n$, and eventually the board 332 (and/or the board 732). Referring next to FIG. 18C, the shingle $\mathbf{950}_2$ can be lowered on top of the shingle $\mathbf{950}_1$, completing the process of coupling the cave roof panel 320 and the subsequent roof panel 720.

As shown in FIG. 18C, once the cave roof panel 320 and the subsequent roof panel 720 are coupled together, (i) the nails 555 are driven through the shingles 550, and $\mathbf{550}_{n-1}$, and is covered by the shingle $\mathbf{950}_1$, (ii) the nails 1855 are driven through the shingles $\mathbf{950}_1$ and $\mathbf{550}_n$, and is covered by the shingle $\mathbf{950}_2$, and (iii) the nails 1055 are driven through the shingles $\mathbf{950}_2$ and $\mathbf{950}_1$, and is covered by the shingle 9503. Therefore, all rows of nails are driven through two shingles, thereby coupling those two shingles together and to the boards 332 or 732, and are covered by another shingle for protection from the elements and remaining hidden (e.g., for aesthetics of the roof). Furthermore, by interweaving the second layer 840 between the second layer 440 and the shingle $\mathbf{550}_n$, the roof can have proper waterproofing notwithstanding having multiple panels coupled together thereon.

Figure 19:
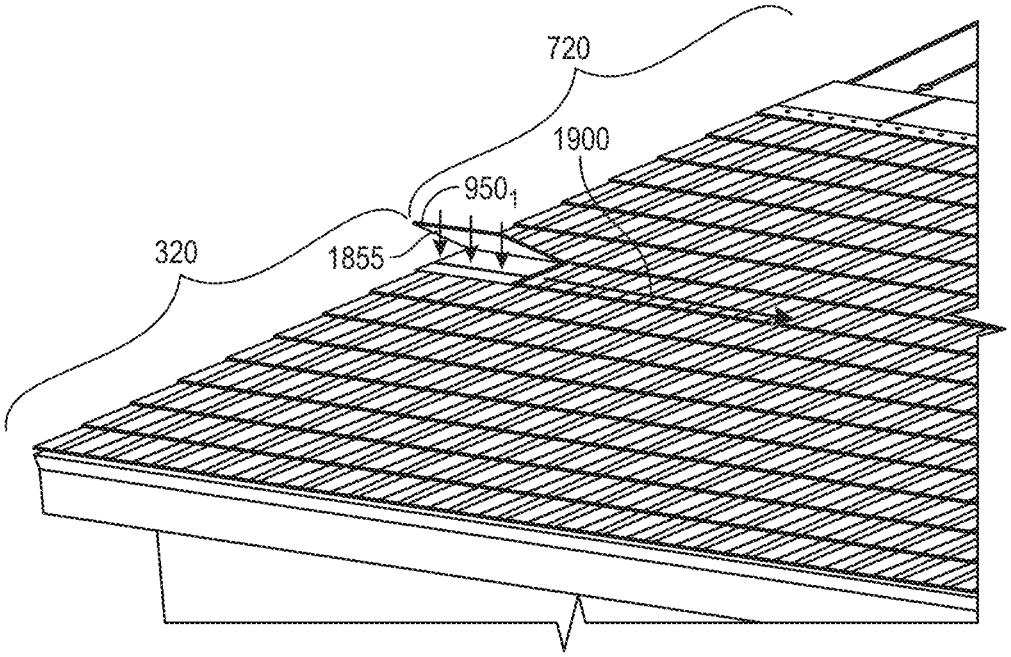
FIG. 19 illustrates a repeatable process for attaching adjacent roof panels, configured in accordance with embodiments of the present technology.

FIG. 19 illustrates a repeatable process for attaching adjacent roof panels, configured in accordance with embodiments of the present technology. As shown and previously mentioned, each of the cave roof panel 320 and the subsequent roof panel 720 can have a plurality of shingle columns. Therefore, when coupling the cave roof panel 320 to the subsequent roof panel 720 on-site, an operator or apparatus (e.g., a robot) can lift the shingles (e.g., the shingle $\mathbf{950}_1$) to apply the nails 1855 as discussed above with reference to FIGS. 18A-18C, and repeat the process for shingles in other columns, proceeding in, e.g., a lateral direction 1900.

Figure 20:
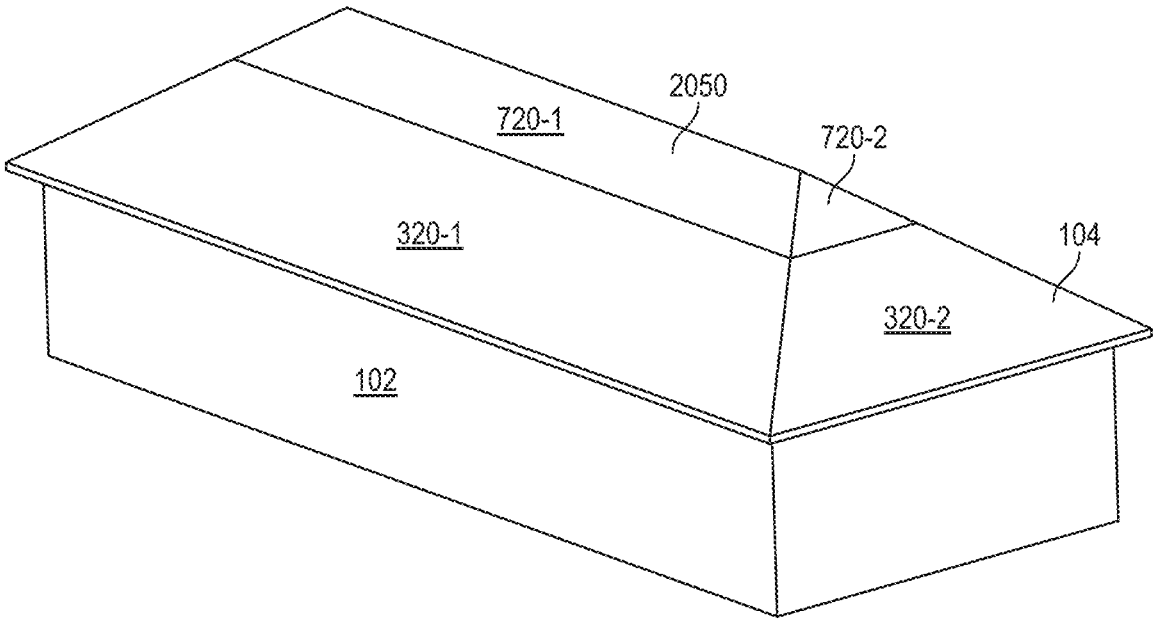
FIG. 20 illustrate installation of ridge cap shingles on a roof, configured in accordance with embodiments of the present technology.

FIG. 20 illustrate installation of ridge cap shingles 2050 on the roof 104, configured in accordance with embodiments of the present technology. As shown, a first cave roof panel 320-1 and a first subsequent roof panel 720-1 are installed on one side of the roof 104, and a second cave roof panel 320-2 and a second subsequent roof panel 720-2 are installed on another side of the roof 104. Additional roof panels can be installed on the sides of the roof 104 not shown in FIG. 20. Subsequently, the ridge cap shingles 2050 can be installed along the ridges of the roof 104.

IV. Other Embodiments of Roof Panels and Related Structures

In some cases, a roof may be longer than the length that a single roof panel (e.g., the cave roof panel 320, the subsequent roof panel 720) can cover. For example, as previously mentioned, the length of a single roof panel can be limited by transportation parameters (e.g., the length of the truck used to transport the roof panel from the off-site factory to the on-site roof), material properties, etc. Therefore, it can be advantageous to have roof panels that can be easily combined on-site in a lateral direction while ultimately providing proper waterproofing, protection from the elements, etc.

Figure 21:
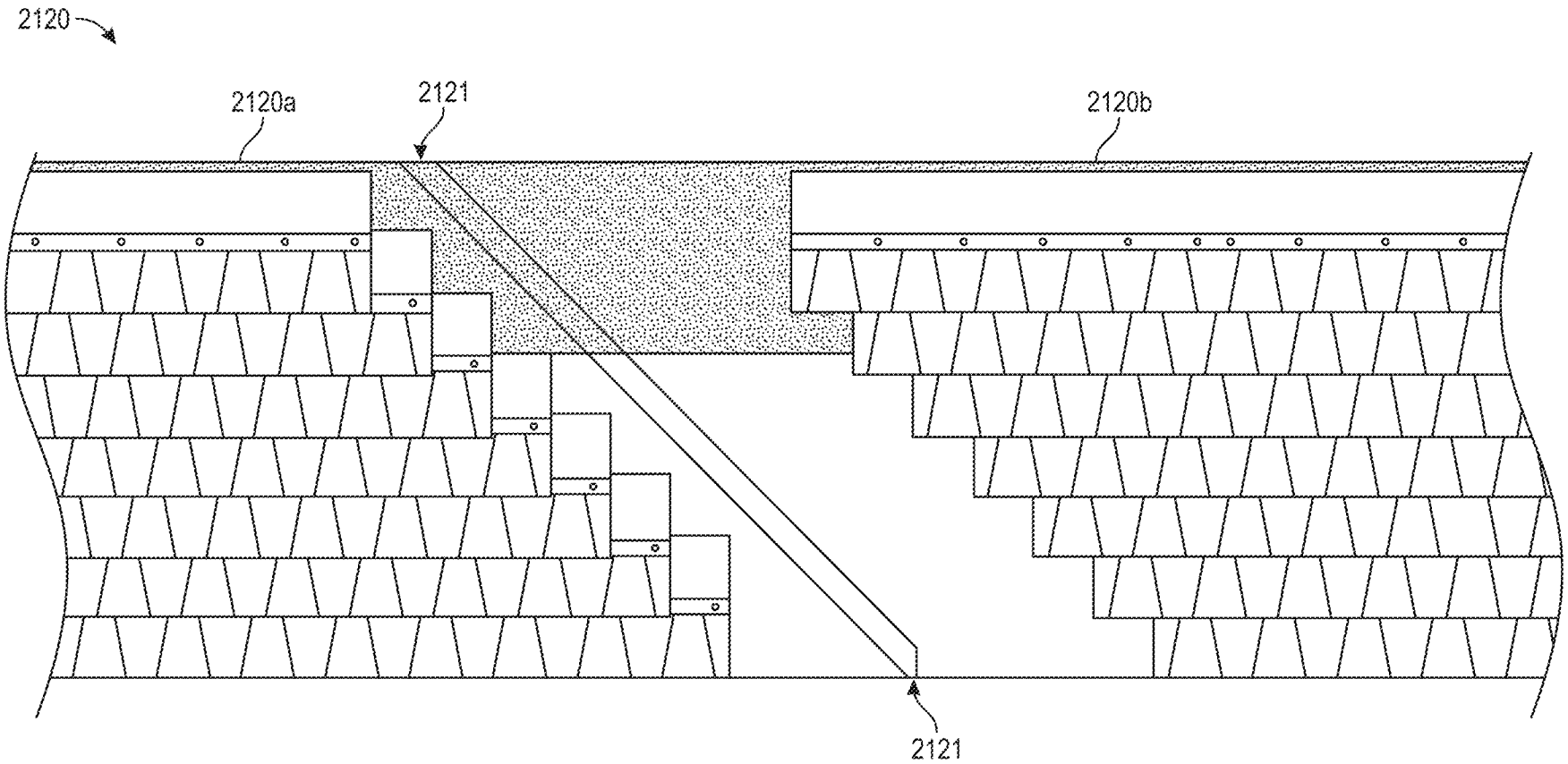
FIG. 21 is a front view of a laterally combined roof panel, configured in accordance with embodiments of the present technology.

FIG. 21 is a front view of a laterally combined roof panel 2120 configured in accordance with embodiments of the present technology. The roof panel 2120 can include a first or left panel 2120*a* and a second or right panel 2120*b* coupled to the left panel 2120*a*. In the illustrated embodiment, the left panel 2120*a* and the right panel 2120*b* share a diagonal boundary 2121. FIGS. 22A-25 illustrate further details of the components and assembly of the left panel 2120*a* and the right panel 2120*b*.

Figure 22A:
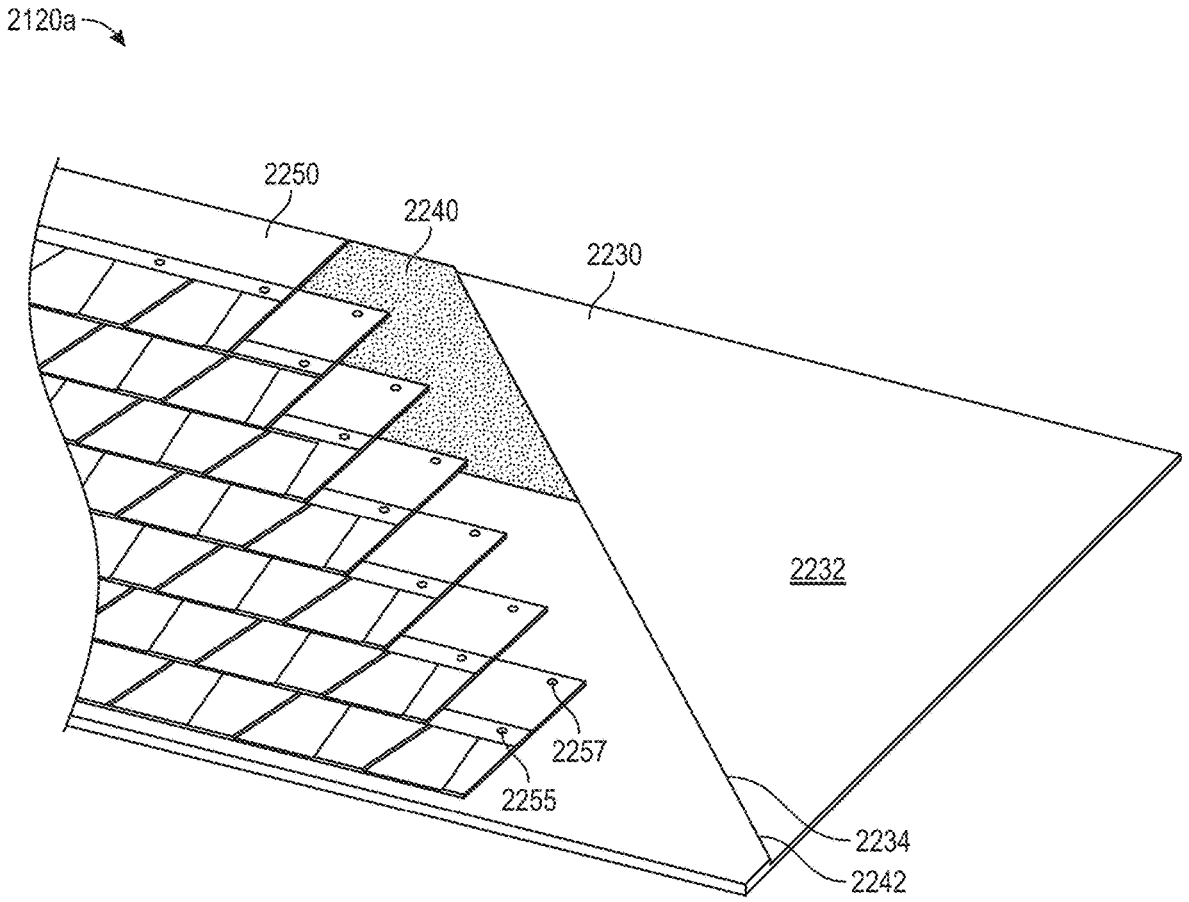
FIGS. 22A-22C are front perspective, front, and rear views, respectively, of a first panel of the laterally combined roof panel of FIG. 21.
Figure 22B:
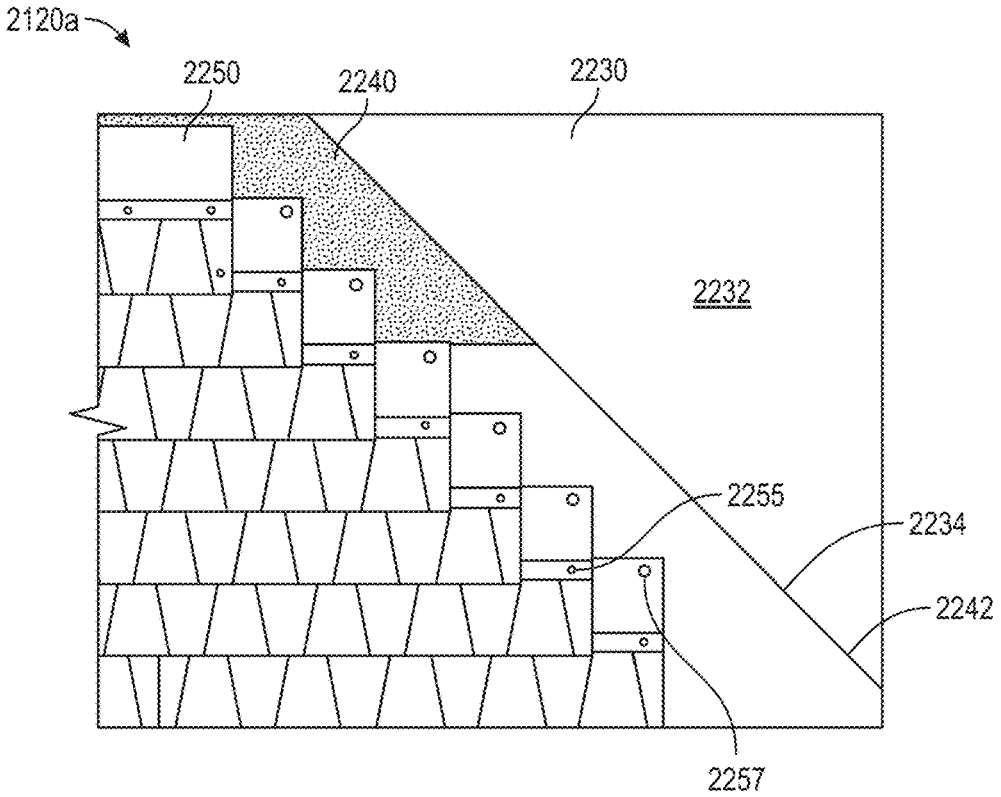
Figure 22C:
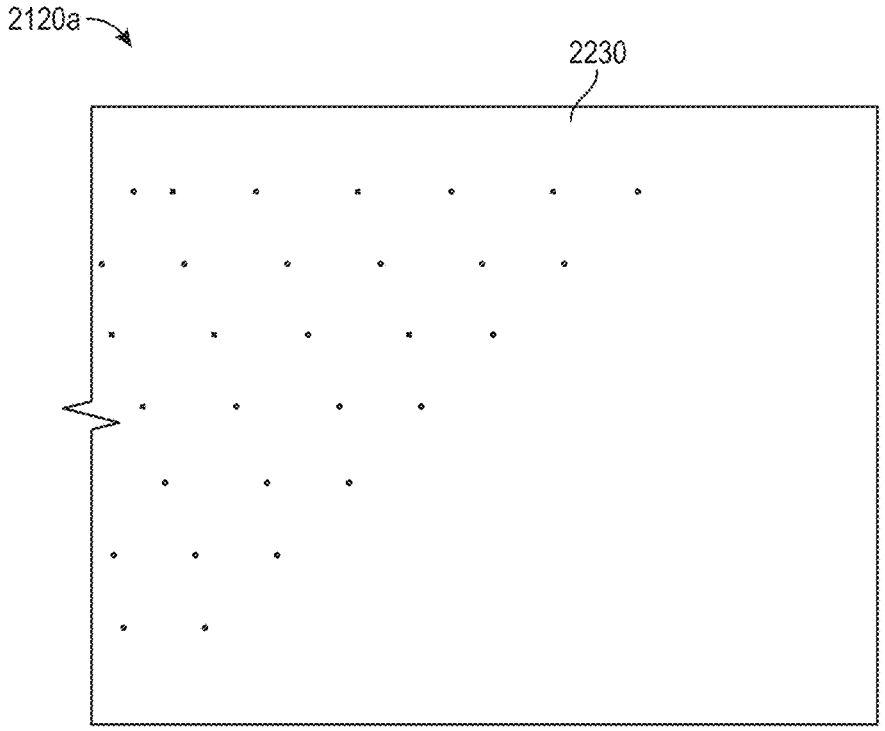

FIGS. 22A-22C are front perspective, front, and rear views, respectively, of the left panel 2120*a*. Referring to FIGS. 22A-22C together, the left panel 2120*a* can include a first layer 2230, a second layer 2240, and a plurality of shingles 2250. In some embodiments, the first layer 2230, the second layer 2240, and the shingles 2250 are generally similar to the first layer 330, 730, the second layer 440, 840, and the shingles 550, 950, respectively, in material and/or function. For example, the first layer 2230 can comprise one or more plywood boards, the second layer 2240 can include IWS and underlayment, and the shingles 2250 can comprise asphalt and fiberglass matt composites.

In the illustrated embodiment, while the first layer 2230 is generally rectangular in overall shape, the first layer 2230 includes a triangular recessed region 2232 on the front and at the right side that will interface the right panel 2120*b*. The first layer 2230 can be milled to form the region 2232. In some embodiments, the region 2232 is milled to 30-70% of the total thickness, such as about 50%. Once formed, the triangular recessed region 2232 can define a diagonal ledge 2234. The second layer 2240 can be shaped (e.g., cut) to have a diagonal edge 2242 positioned to align with the diagonal ledge 2234, as shown. The shingles 2250 can be coupled to the first layer 2230 and the second layer 2240 via nails 2255 in a manner similar to the shingles 550 and 950 as discussed above. In particular, the shingles 2250 are arranged in a cascading arrangement such that the rightmost shingles 2250 of each row generally follow, without crossing over, the diagonal edge 2242. Notably, when prefabricated off-site, the left panel 2120*a* may not include nails near the top-right corners of the rightmost shingles 2250, as indicated by the circles 2257. The topmost row of shingles 2250 may not include nails at their top portions to allow coupling to panels stacked above, as discussed above with respect to FIGS. 18A-18C.

Figure 23A:
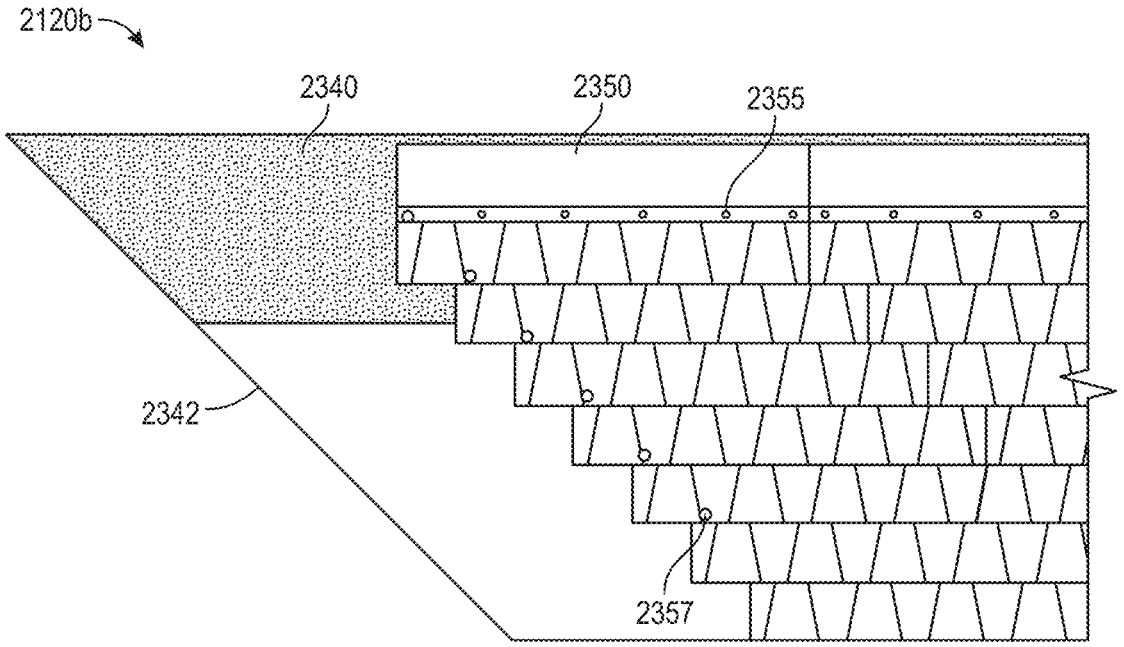
FIGS. 23A and 23B are front and rear views, respectively, of a second panel of the laterally combined roof panel of FIG. 21.
Figure 23B:
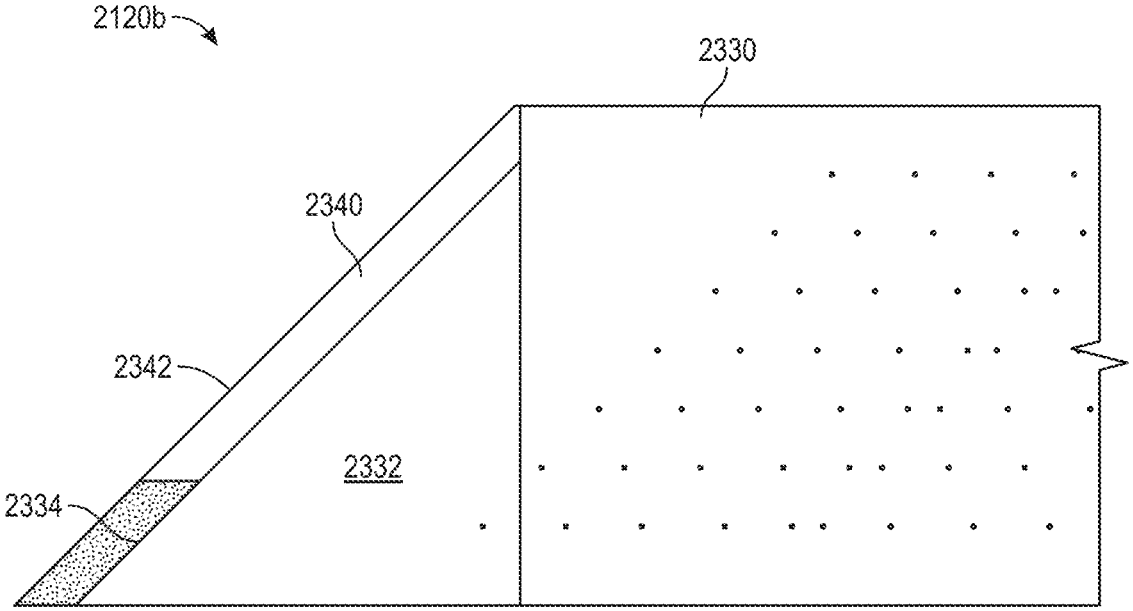

FIGS. 23A and 23B are front and rear views, respectively, of the right panel 2120*b*. Referring to FIGS. 23A-23C together, the right panel 2120*b* can include a first layer 2330, a second layer 2340, and a plurality of shingles 2350. In some embodiments, the first layer 2330, the second layer 2340, and the shingles 2350 are generally similar to the first layer 330, 730, the second layer 440, 840, and the shingles 550, 950, respectively, in material and/or function. For example, the first layer 2330 can comprise one or more plywood boards, the second layer 2340 can include IWS and underlayment, and the shingles 2350 can comprise asphalt and fiberglass matt composites.

In the illustrated embodiment, the first layer 2330 includes a triangular recessed region 2332 on the back and at the left side that will interface the left panel 2120*a*. The first layer 2330 can be milled to form the region 2332. In some embodiments, the region 2332 is milled to 30-70% of the total thickness, such as about 50%. Once formed, the triangular recessed region 2332 can define a diagonal ledge 2334. The second layer 2340 can be shaped (e.g., cut) to extend beyond the diagonal ledge 2334 and have a diagonal edge 2342 laterally spaced apart from the diagonal ledge 2234, as shown. The shingles 2350 can be coupled to the first layer 2330 and the second layer 2340 via nails 2355 in a manner similar to the shingles 550 and 950 as discussed above. In particular, the shingles 2350 are arranged in a cascading arrangement such that the leftmost shingles 2350 of each row generally follow, without crossing over, the diagonal edge 2342. Notably, when prefabricated off-site, the right panel 2120*b* may not include nails near the left edges and on the middle portions of the leftmost shingles 2350, except for the shingles 2350 on Row 1, as indicated by the circles 2357. The topmost row of shingles 2350 may not include nails at their top portions to allow coupling to panels stacked above, as discussed above with respect to FIGS. 18A-18C.

Figure 24:
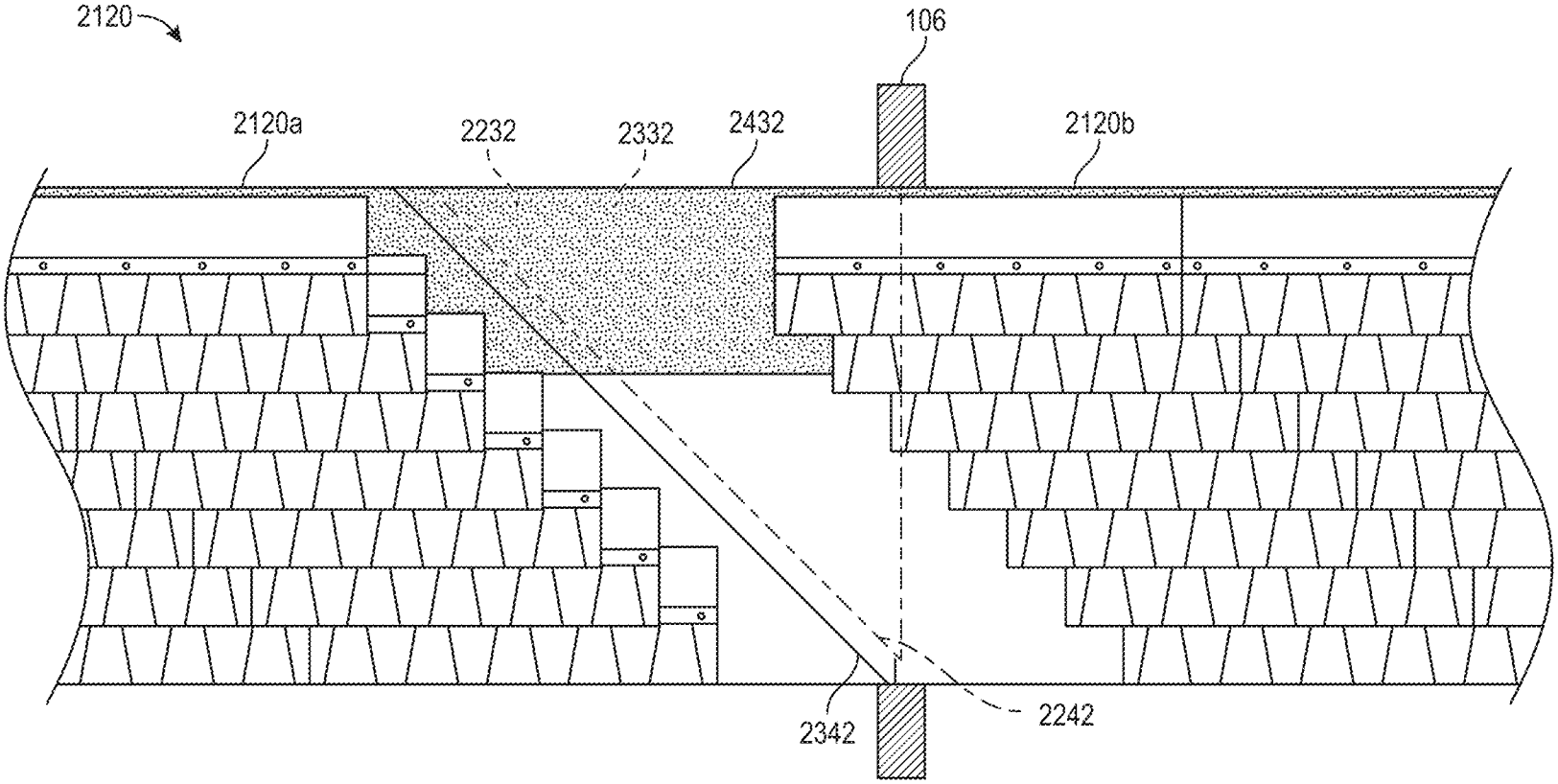
FIG. 24 illustrates assembly of the laterally combined roof panel of FIG. 21.

FIG. 24 illustrates on-site assembly of the laterally combined roof panel 2120. As shown, the left panel 2120*a* and the right panel 2120*b* partially overlap such that the regions 2232 and 2332 align and overlap, as indicated by the triangle 2432. Therefore, in some embodiments, the regions 2232 and 2332 are formed to have the same sizes and dimensions at the off-site prefabrication stage. The diagonal edge 2242 of the left panel 2120*a* aligns with the hypotenuse of the triangle 2432 while the diagonal edge 2342 extends beyond the triangle 2432. Therefore, when the laterally combined roof panel 2120 is assembled as shown, a portion of the second layer 2340 extends over and overlaps with a portion of the second layer 2240. In some embodiments, the laterally combined roof panel 2120 is positioned over a roof such that the right edge of the triangle 2432 is disposed along the center of a rafter 106, as shown.

Figure 25:
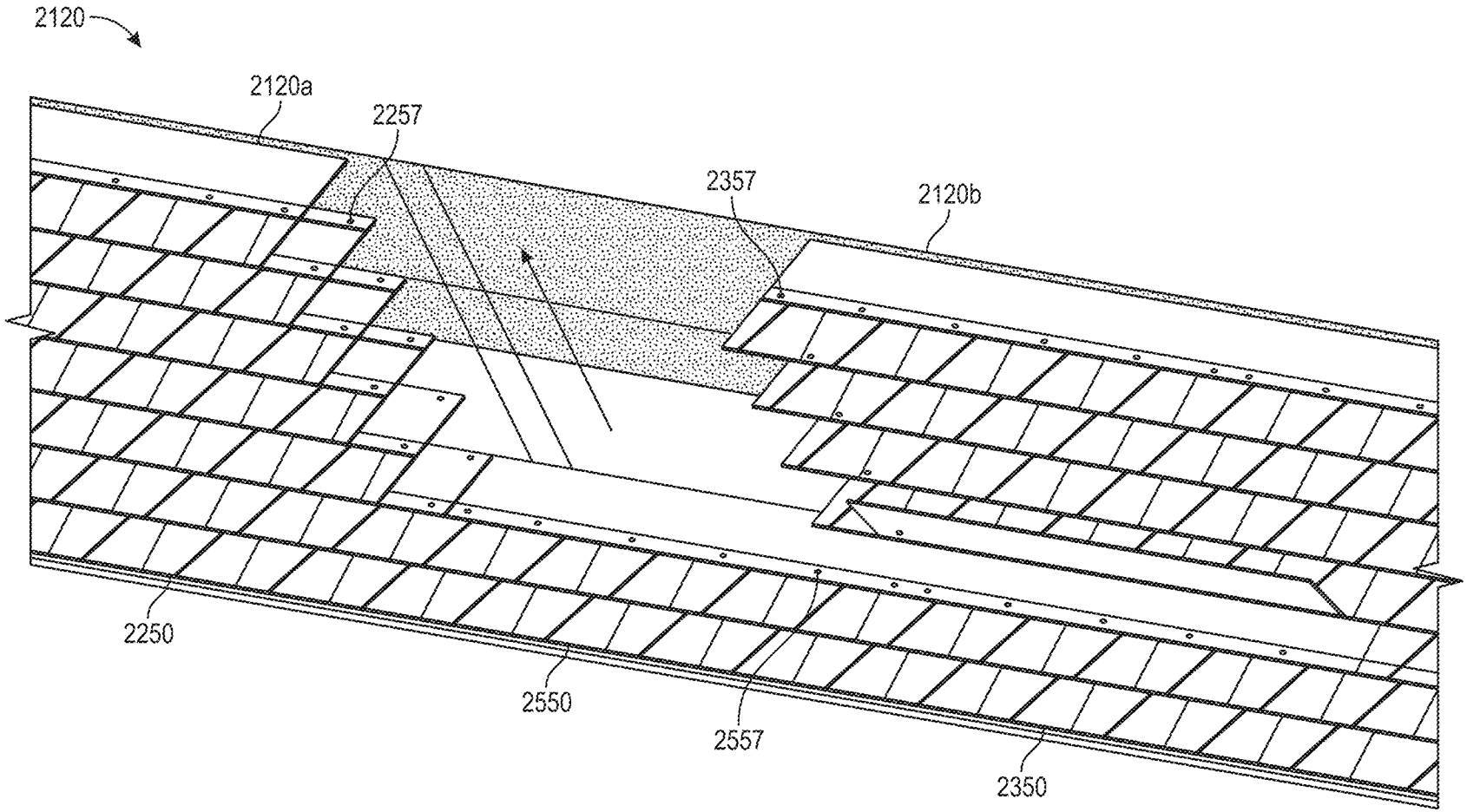
FIG. 25 illustrates installation of intermediate shingles on the laterally combined roof panel of FIG. 21.

FIG. 25 illustrates installation of intermediate shingles 2550 on the laterally combined roof panel 2120. The left panel 2120*a* and the right panel 2120*b* can be prefabricated such that one intermediate shingle 2550 fits in the gap between the rightmost shingle 2250 and the leftmost shingle 2350 of each row, as shown. When installing the intermediate shingles 2550 on-site, the shingles 2350 can be lifted as needed to access spots for nails, represented by circles 2557. Also, as the intermediate shingles 2550 are installed, a first set of select nails can each be applied at the circles 2257 to be driven through both (i) one of the shingles 2250 and (ii) one of the intermediate shingles 2550, and a second set of select nails can each be applied at the circles 2357 to be driven through both (i) one of the shingles 2350 and (ii) one of the intermediate shingles 2550. Thus, the circles 2257, 2357 represent points on the shingles 2250, 2350, respectively, that omit nails at the off-site prefabrication stage due to the absence of the intermediate shingles 2550. The process can repeat diagonally upwards, as indicated by the arrow, until all of the intermediate shingles 2550 are installed.

Figure 26:
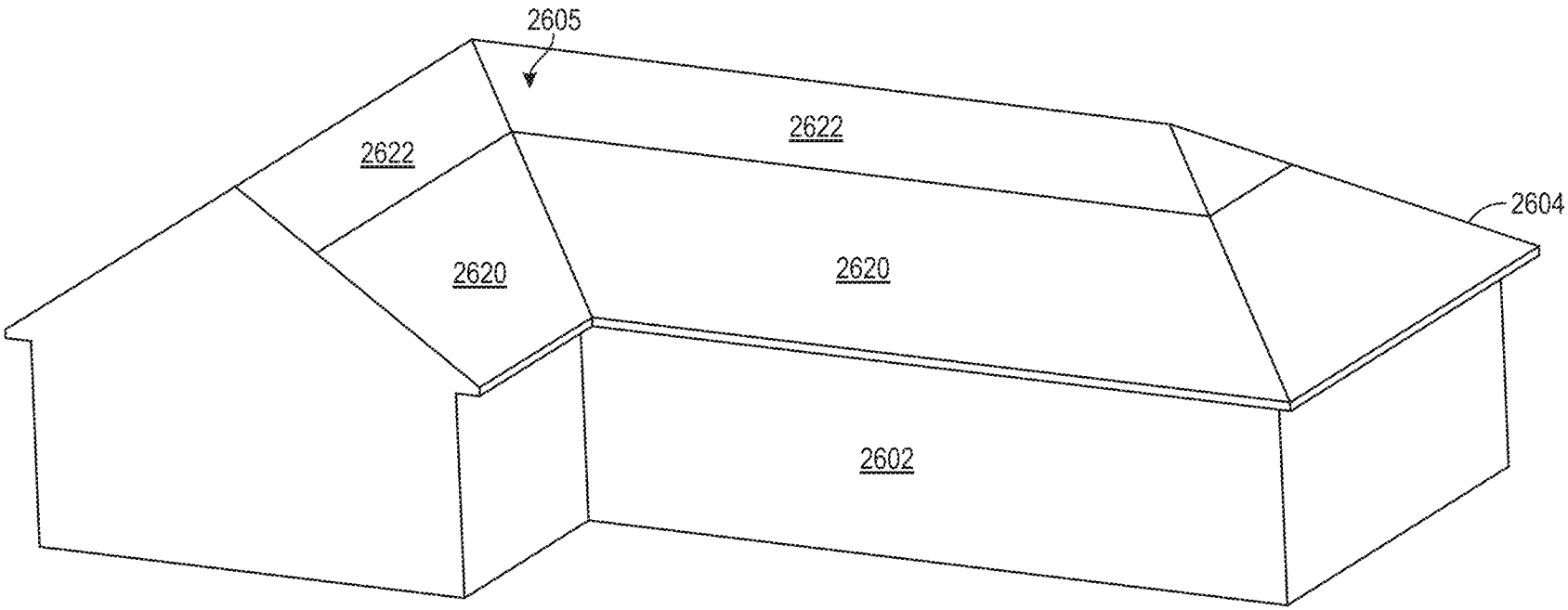
FIG. 26 is a schematic perspective view of roof panels installed on a roof with a valley, configured in accordance with embodiments of the present technology.

FIG. 26 is a schematic perspective view of a structure 2602 having a roof 2604 with a valley 2605 and having roof panels installed thereon, configured in accordance with embodiments of the present technology. As shown, the roof 2604 can include a plurality of cave roof panels 2620 and a plurality of subsequent roof panels 2622. At the off-site prefabrication stage, the roof panels 2620, 2622 can be manufactured such that shingles are placed up until, but not over, where the valley 2605 would be when the roof panels 2620, 2622 are installed. In some embodiments, an open valley is created at the valley 2605 by installing a flashing along the line of the valley 2605 and installing the roof panels 2620, 2622 with shingles that terminate near the flashing. In some embodiments, a closed valley (e.g., a woven valley, a cut valley) is created at the valley 2605 by installing additional shingles thereat. The additional shingles can be installed between the roof panels 2620, 2622 in a similar manner as the intermediate shingles 2550 illustrated in FIG. 25.

Figure 27:
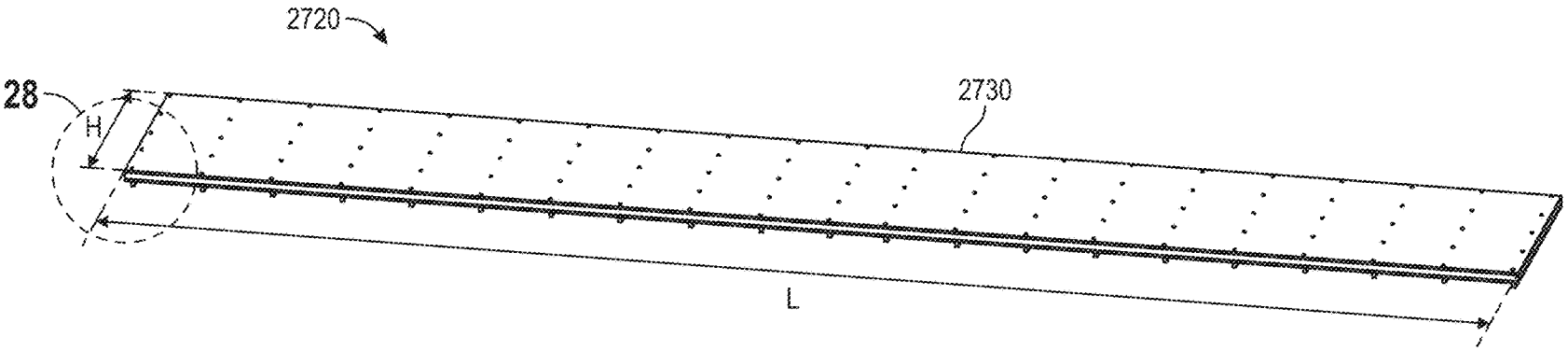
FIG. 27 is a front perspective view of a first layer of a roof panel, configured in accordance with embodiments of the present technology.

FIG. 27 is a front perspective view of a first layer 2730 of a roof panel 2720, configured in accordance with embodiments of the present technology. The roof panel 2720 can be an example of the roof panel 220 of FIG. 2, and the first layer 2730 can be an example of the first layer 230. As shown, the first layer 2730 has a generally rectangular form factor with a length L and a height H, which can vary depending on the roof on which the roof panel 2720 is to be installed. In some embodiments, for example, the roof panel 2720 can have a length L between 10-50 feet (e.g., about 24 feet) and a height H between 1-10 feet (e.g., about 4 feet).

Figure 28:
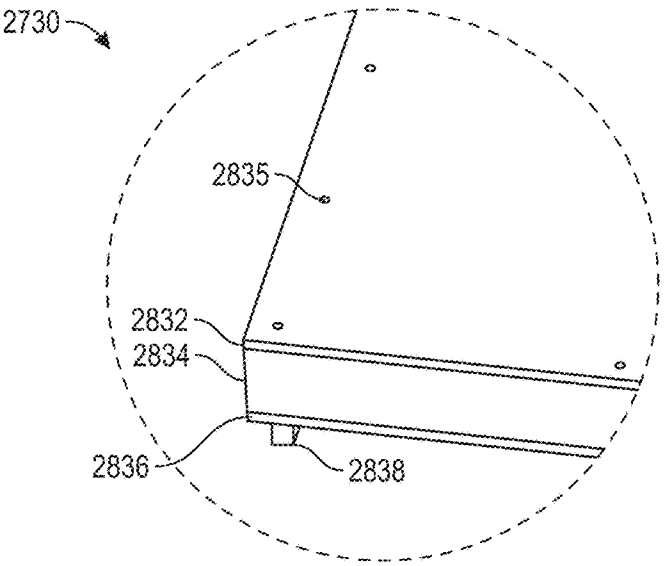
FIG. 28 is an enlarged front perspective view of the first layer of FIG. 27.

FIG. 28 is an enlarged front perspective view of the first layer 2730. In the illustrated embodiment, the first layer 2730 includes a top layer 2832, a middle layer 2834, a bottom layer 2836, and a plurality of blockings 2838. The top layer 2832 is disposed over the middle layer 2834, the middle layer 2834 is disposed over the bottom layer 2836, and the blockings 2838 are coupled to a rear side of the bottom layer 2836. In some embodiments, each of the top layer 2832, the middle layer 2834, and/or the bottom layer 2836 can comprise a continuous layer. Notably, the illustrated embodiment of the first layer 2730 does not include a splice plate (e.g., the splice plates 334, the splice plates 734). The thickness provided by the multiple layers and the continuous construction of each layer can eliminate the need for such splice plates.

In some embodiments, the first layer 2730 comprises a structural insulated panel (SIP). For example, the top layer 2832 can comprise exterior sheathing, the middle layer 2834 can comprise insulation (e.g., a foam core), and the bottom layer 2836 can comprise interior sheathing. The blockings 2838 can comprise elongate blocks that extend along the height H of the first layer 2730 and spaced apart from one another along the length L of the first layer 2730. A plurality of fasteners 2835 (e.g., screws) can couple the top layer 2832, the middle layer 2834, the bottom layer 2836, and the plurality of blockings 2838 together. By including a SIP, the roof panel 2720 can provide sufficient insulation for energy efficient structures.

Figure 29:
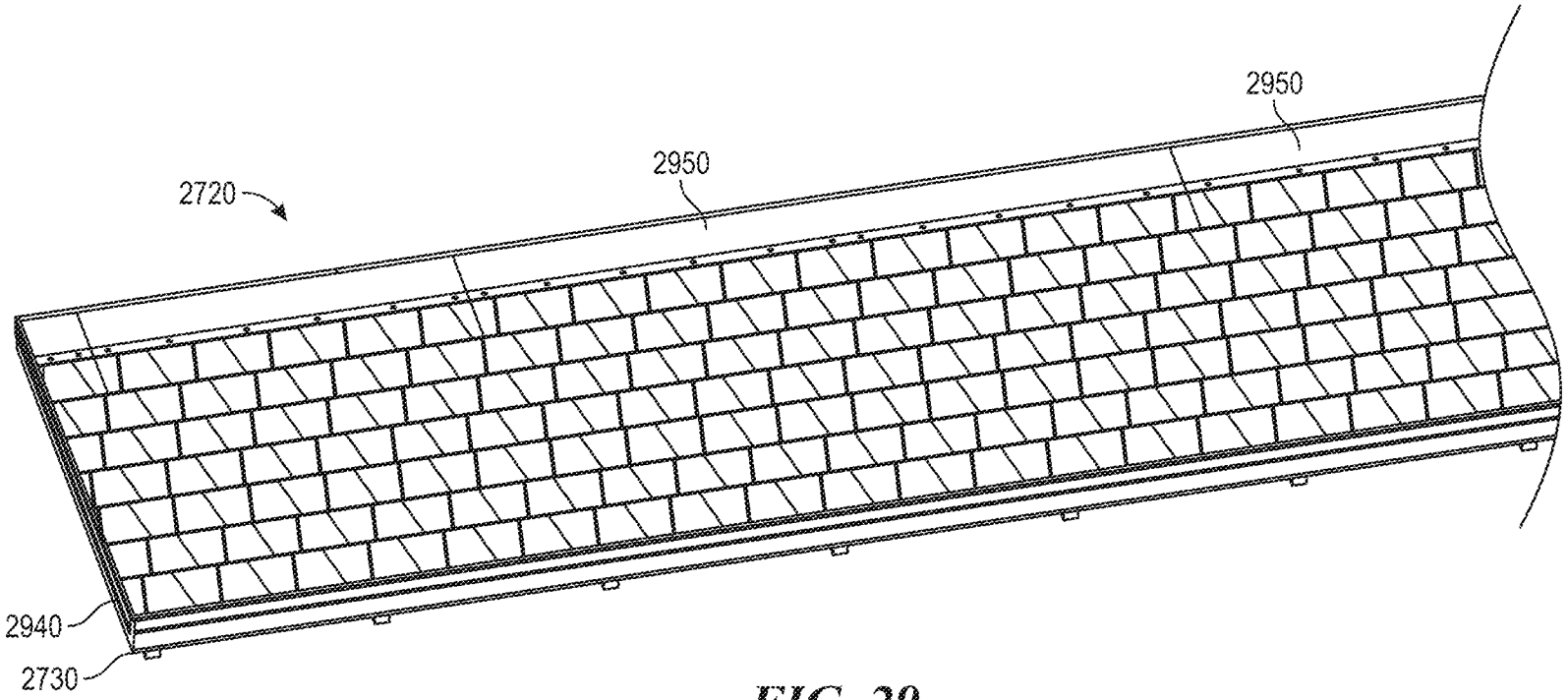
FIG. 29 is an enlarged front perspective view of the roof panel of FIG. 27 with other layers, configured in accordance with embodiments of the present technology.

FIG. 29 is an enlarged front perspective view of the roof panel 2720 with a second layer 2940 and a plurality of shingles 2950, configured in accordance with embodiments of the present technology. The second layer 2940 can be an example of the second layer 240 of FIG. 2, and can be disposed between the first layer 2730 and the plurality of shingles 2950. The shingles 2950 can be examples of the shingles 250. In some embodiments, the second layer 2940 and the shingles 2950 are disposed over the first layer 2730 in a manner similar to how the second layer 440 and the shingles 550 are disposed over the first layer 330, as discussed above with reference to FIGS. 4-6. Moreover, the roof panel 2720 can have varied construction and comprise an cave roof panel or a subsequent roof panel.

Figure 30:
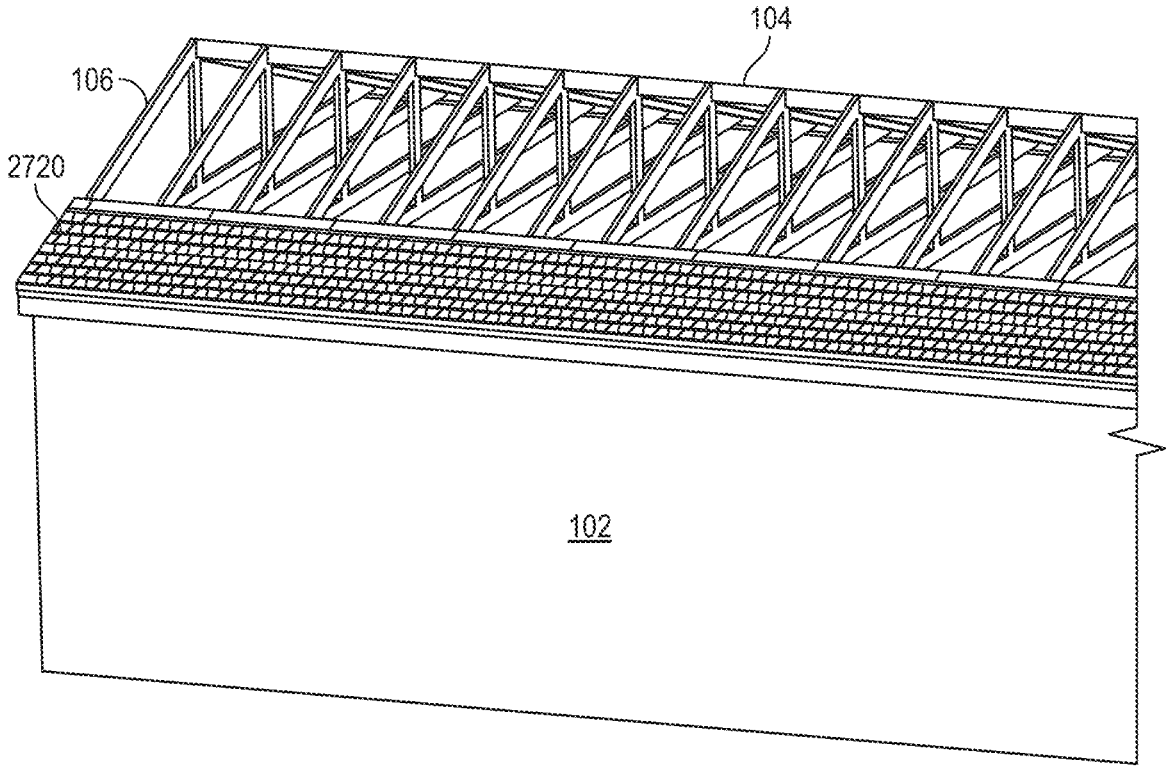
FIGS. 30 and 31 illustrate on-site placement and attachment, respectively, of the roof panel of FIG. 29 on a roof, configured in accordance with embodiments of the present technology.
Figure 31:
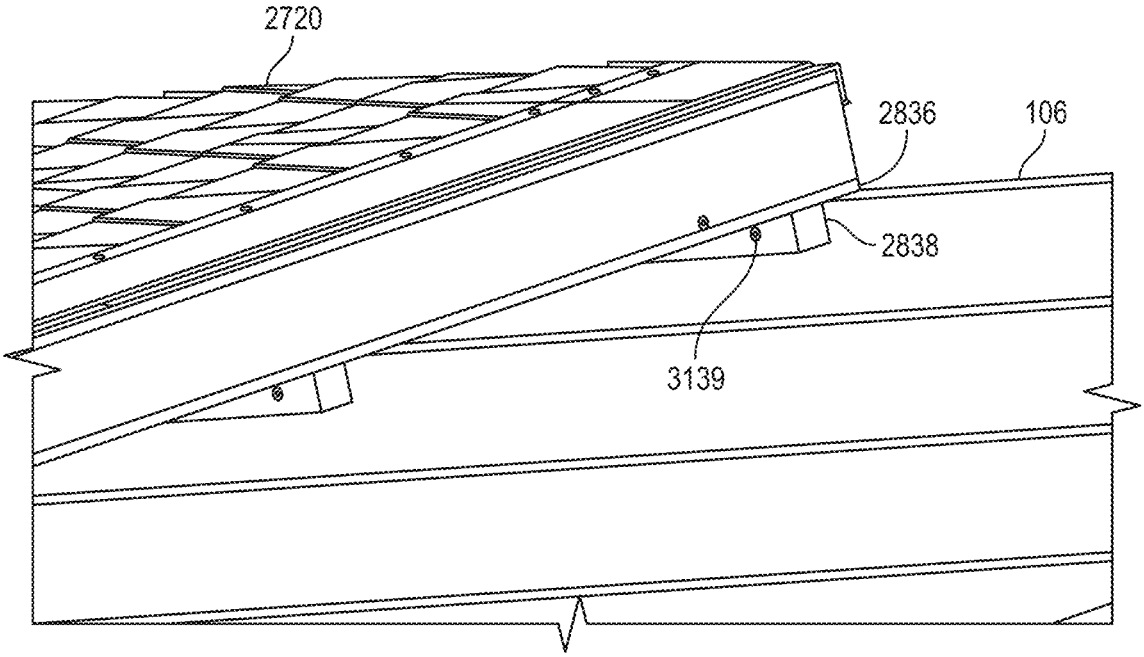

FIGS. 30 and 31 illustrate on-site placement and attachment, respectively, of the roof panel 2720 on the roof 104 of the structure 102, configured in accordance with embodiments of the present technology. As shown in FIG. 30, the roof panel 2720 can be placed on the rafters 106 to extend along a length of the roof 104 in a manner similar to how the cave roof panel 320 is placed on the roof 104 as illustrated in FIG. 17A. Notably, unlike in FIG. 17A, the rafters 106 in FIG. 30 are not configured with brackets (e.g., the brackets 1310). Instead, as shown in FIG. 31, the roof panel 2720 is coupled to the rafters 106 via fasteners 3139 (e.g., screws). More specifically, the roof panel 2720 can be placed on the roof 104 such that the bottom layer 2836 is placed over (e.g., directly on) the top edges of the rafters 106 and the plurality of blockings 2838 are positioned adjacent to the rafters 106. In particular, one side surface of one of the blockings 2838 is positioned to be in contact with a side surface of a corresponding one of the rafters 106, and the fasteners 3139 can be applied to couple the blockings 2838 to the corresponding rafters 106. Therefore, in some embodiments, the roof panel 2720 is prefabricated off-site such that the blockings 2838 are spaced apart by a distance equal to the distance between adjacent rafters 106, which can vary between different structures.

Figure 32:
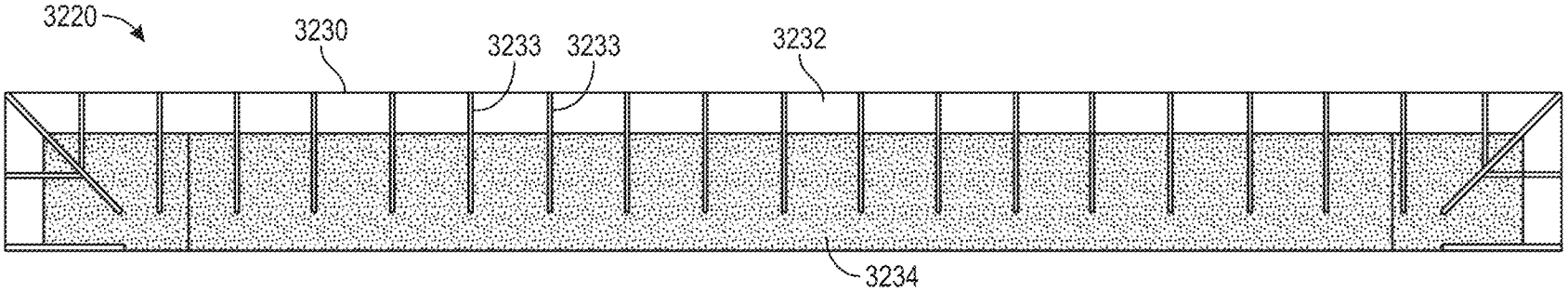
FIGS. 32 and 33 are rear views of a first layer of an eave roof panel, configured in accordance with embodiments of the present technology.
Figure 33:
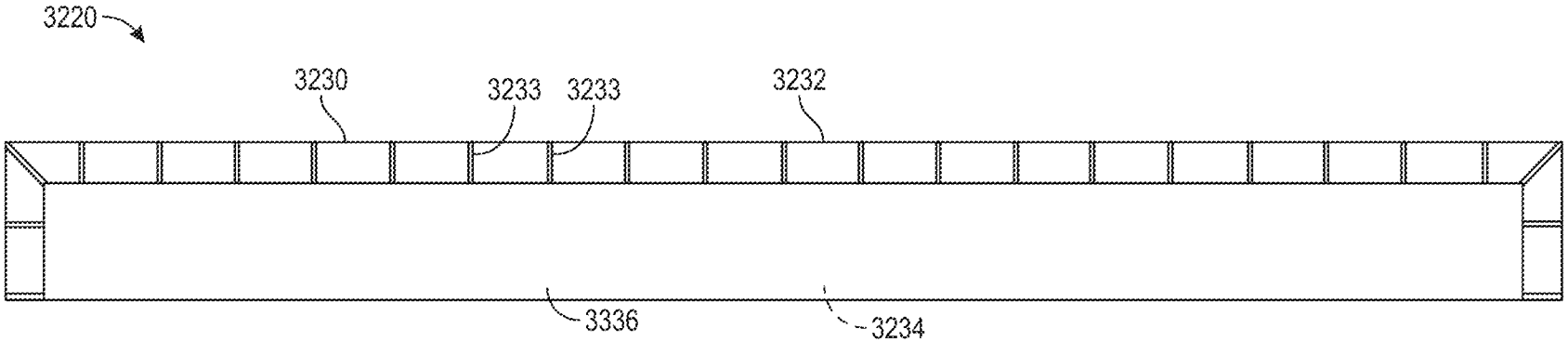

FIGS. 32 and 33 are rear views of a first layer 3230 of an cave roof panel 3220, configured in accordance with embodiments of the present technology. The cave roof panel 3220 can be an example of the roof panel 220 of FIG. 2. Referring first to FIG. 32, the first layer 3230 of the cave roof panel 3220 includes a top layer 3232 (e.g., exterior sheathing) and a middle layer 3234 (e.g., insulation). As shown, the top layer 3232 extends beyond three of the four edges of the middle layer 3234, forming overhangs for the cave roof panel 3220. Referring next to FIG. 33, the cave roof panel 3220 also includes a bottom layer 3336 (e.g., interior sheathing) disposed underneath the middle layer 3234 (obscured in FIG. 33). The middle layer 3234 and the bottom layer 3336 can have identical or generally similar dimensions such that the middle layer 3234 is substantially sandwiched between the top layer 3232 and the bottom layer 3336, and the top layer 3232 extends beyond three of the four edges of each of the middle layer 3234 and the bottom layer 3336.

The first layer 3230 can also include a plurality of blockings 3233 coupled to the rear sides of the middle layer 3234 and the overhanging portion of the top layer 3232. The blockings 3233 can include elongate members that extend inward from and perpendicular to the three overhanging edges of the top layer 3232. Each of the two corners can include a diagonally-oriented blocking 3233 extend inward from the corners. The blockings 3233 can serve as struts that support the overhanging portion of the top layer 3232. Also, portions of the blockings 3233 can be sandwiched between the middle layer 3234 and the bottom layer 3336, which provide support to the blockings 3233 to support the weight of the overhanging portions of the top layer 3232. The blockings 3233 can have any suitable lengths and can be spaced apart from one another by any suitable distance. In some embodiments, for example, individual ones of the blockings 3233 are 4 feet long and spaced apart from one another by 2 feet.

Figure 34:
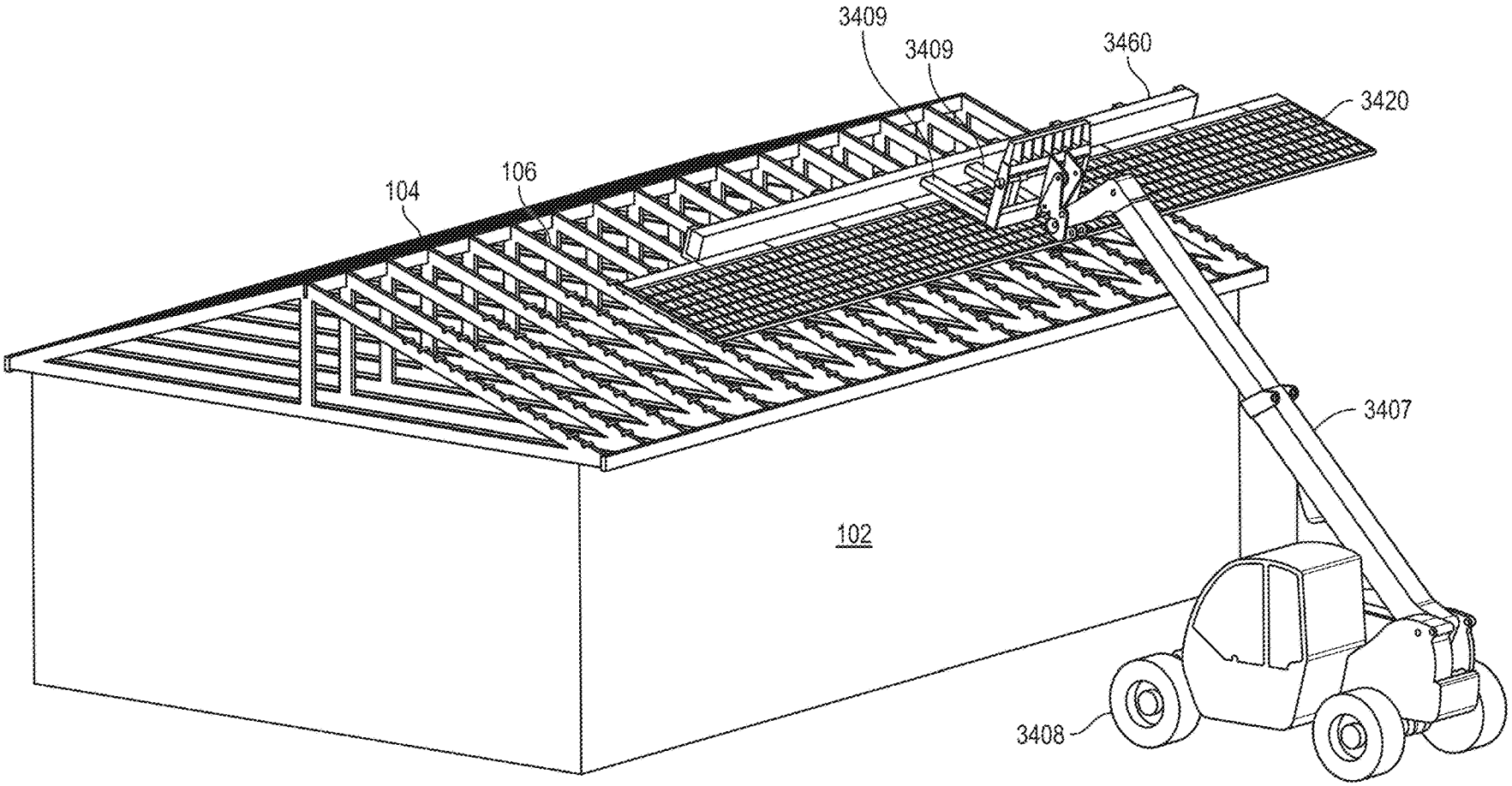
FIG. 34 illustrates on-site handling of a roof panel using a forklift, configured in accordance with embodiments of the present technology.

FIG. 34 illustrates on-site handling of a roof panel 3420 using a forklift 3408, configured in accordance with embodiments of the present technology. The roof panel 3420 can be an example of the roof panel 220 of FIG. 2. The forklift 3408 can be an example of the machine 108 of FIG. 1. In the illustrated embodiment, the forklift 3408 includes a boom 3407 and a pair of tines 3409 at a distal end of the boom 3407. The tines 3409 can be used to lift a forklift adapter 3460, which in turn lifts the roof panel 3420 thereon. Therefore, the forklift 3408 can place the roof panel 3420 onto the rafters 106 forming the roof 104 of the structure 102. Details of the forklift adapter 3460 are discussed below with reference to FIG. 35.

Figure 35:
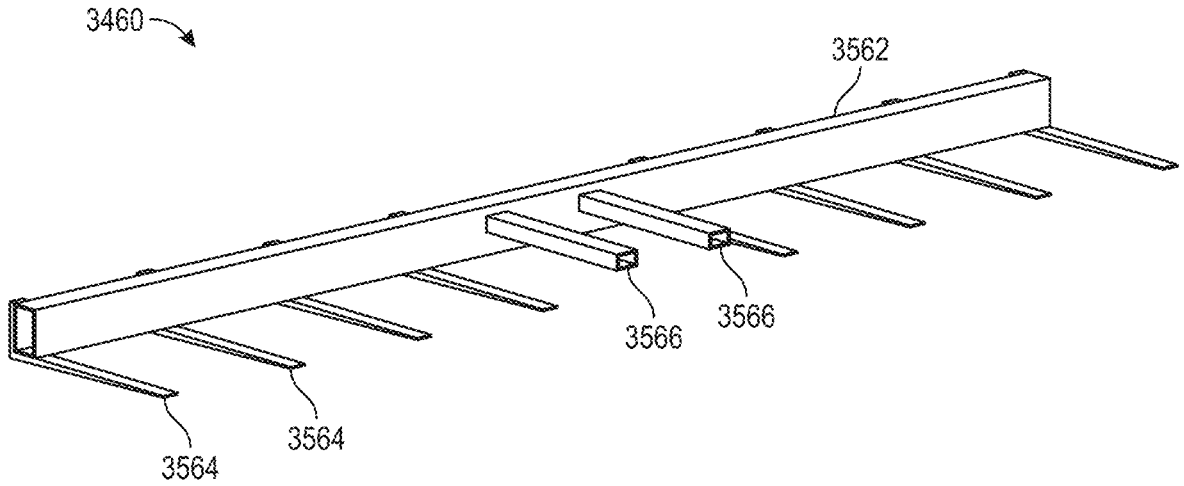
FIG. 35 is a perspective view of a forklift adapter, configured in accordance with embodiments of the present technology.

FIG. 35 is a perspective view of the forklift adapter 3460, configured in accordance with embodiments of the present technology. The forklift adapter 3460 can include an elongate beam 3562, a plurality of arms 3564 coupled to the elongate beam 3562, and a pair of tine receivers 3566 coupled to the elongate beam 3562. The arms 3564 can extend generally perpendicular to the elongate beam 3562 and spaced apart from one another along the length of the elongate beam 3562. The pair of tine receivers 3566 can also extend generally perpendicular to the elongate beam 3562 (e.g., parallel to the arms 3564) and can be spaced apart from one another by the distance between the tines 3409 of the forklift 3408 (FIG. 34). Notably, the tine receivers 3566 are positioned above the arms 3564. While the elongate beam 3562 and the pair of tine receivers 3566 each comprises a hollow tube with a rectangular cross-section in the illustrated embodiment, the elongate beam 3562 and the pair of tine receivers 3566 can have other shapes in other embodiments. Also, while the arms 3564 each comprise flat, elongate members that taper away from the elongate beam 3562, the arms 3564 can have other shapes in other embodiments.

Referring to FIGS. 34 and 35 together, to place the roof panel 3420 on the rafters 106, the roof panel 3420 can be placed on the arms 3564 of the forklift adapter 3460 (e.g., and below the tine receivers 3566), and the forklift 3408 can be operated to insert the tines 3409 into the corresponding tine receivers 3566, and subsequently lift the forklift adapter 3460 and the roof panel 3420 thereon. Once the roof panel 3420 is placed in the correct position, the forklift 3408 can be operated to push the forklift adapter 3460 out from below the roof panel 3420 and bring the forklift adapter 3460 back to ground level, where another roof panel can be placed thereon. It is appreciated that the forklift 3408 and the forklift adapter 3460 can be used to install any of the roof panels disclosed herein, such as the roof panel 320, the subsequent roof panel 720, the roof panel 2120, the roof panel 2720, and the roof panel 3220, and/or other embodiments of roof panels.

V. Prefabrication of Roof Panels

Different structures can have different roof geometries, and accordingly, customizing panel geometry for a particular roof can facilitate prefabrication of roof panels that can cover the particular roof properly. One method of customizing roof panels is to analyze the particular roof and determine, prior to or after prefabrication, the dimensions, number, and/or layout of the roof panels on the particular roof.

Figure 36:
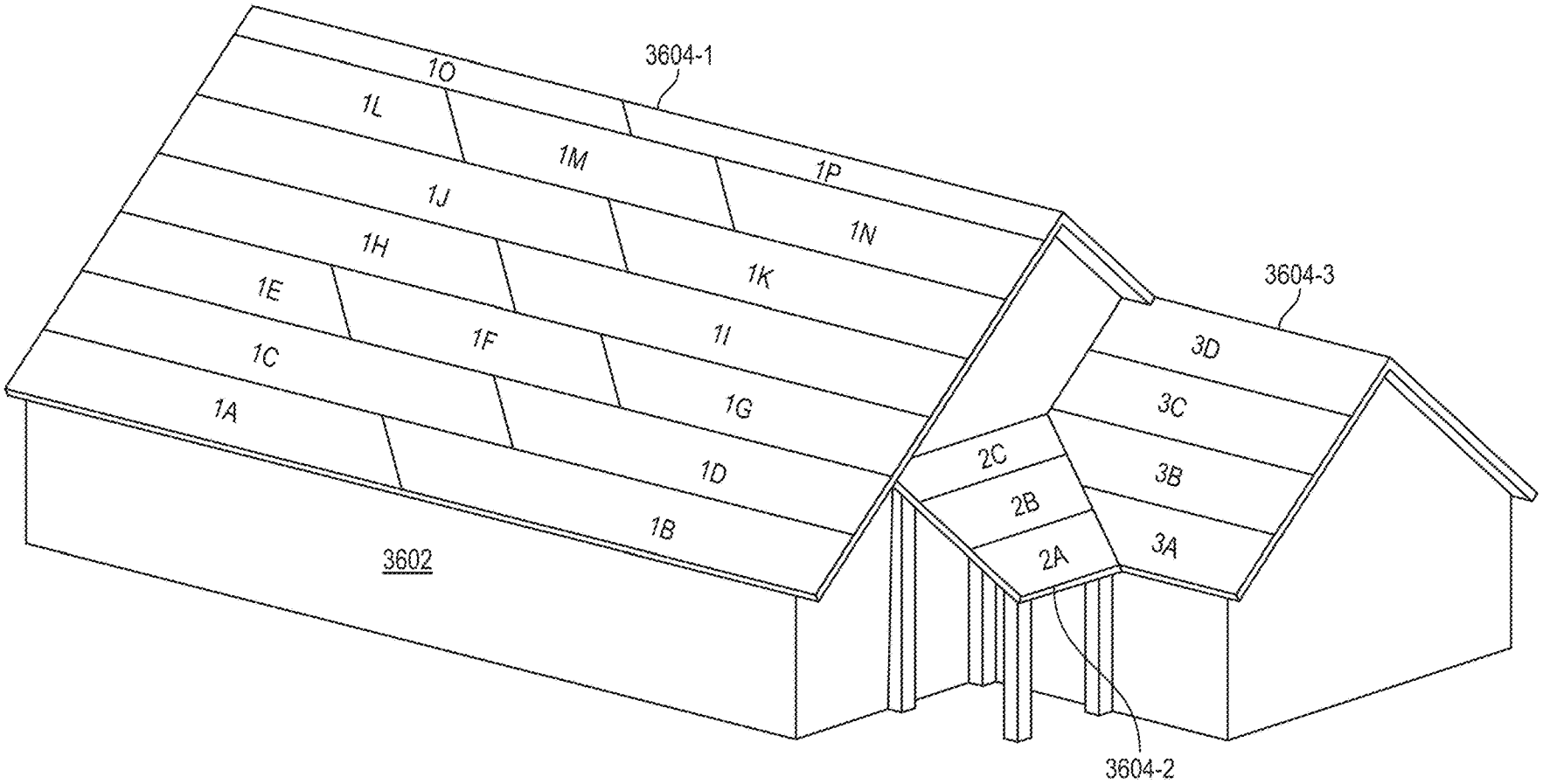
FIG. 36 illustrates roof segmentation for determining panel geometry, configured in accordance with embodiments of the present technology.

FIG. 36 illustrates roof segmentation for determining panel geometry, configured in accordance with embodiments of the present technology. In the illustrated embodiment, a structure 3602 includes a first roof plane 3604-1, a second roof plane 3604-2, and a third roof plane 3604-3 (collectively referred to as "the roof planes 3604"). Each of the roof planes 3604 can be analyzed (e.g., by human inspectors, by imaging systems and associated algorithms) to determine its shape, dimensions, angle, interactions with other roof planes 3604 (e.g., forming valleys), etc. Then, each of the roof planes 3604 can be conceptually partitioned into one or more panel zones that each represent one roof panel.

For example, in FIG. 36, the first roof plane 3604-1 is partitioned into 16 panel zones 1A-1P, the second roof plane 3604-2 is partitioned into three panel zones 2A-2C, and the third roof plane 3604-3 is partitioned into four panel zones 3A-3D. As shown, the panel zones on each of the roof planes 3604 are arranged in a plurality of rows. In particular, the first roof plane 3604-1 includes two or three panel zones arranged laterally in each row. Accordingly, the roof panels for the first roof plane 3604-1 can be prefabricated and subsequently installed thereon as described above with reference to FIGS. 21-25. In some embodiments, the panel zones 1A-1P are created such that the boundaries between laterally arranged roof panels lie on rafters, as previously mentioned. The second roof plane 3604-2 and the third roof plane 3604-3 form a valley. Accordingly, the roof panels for the second roof plane 3604-2 and the third roof plane 3604-3 can be prefabricated and subsequently installed thereon as described above with reference to FIG. 26.

Figure 37:
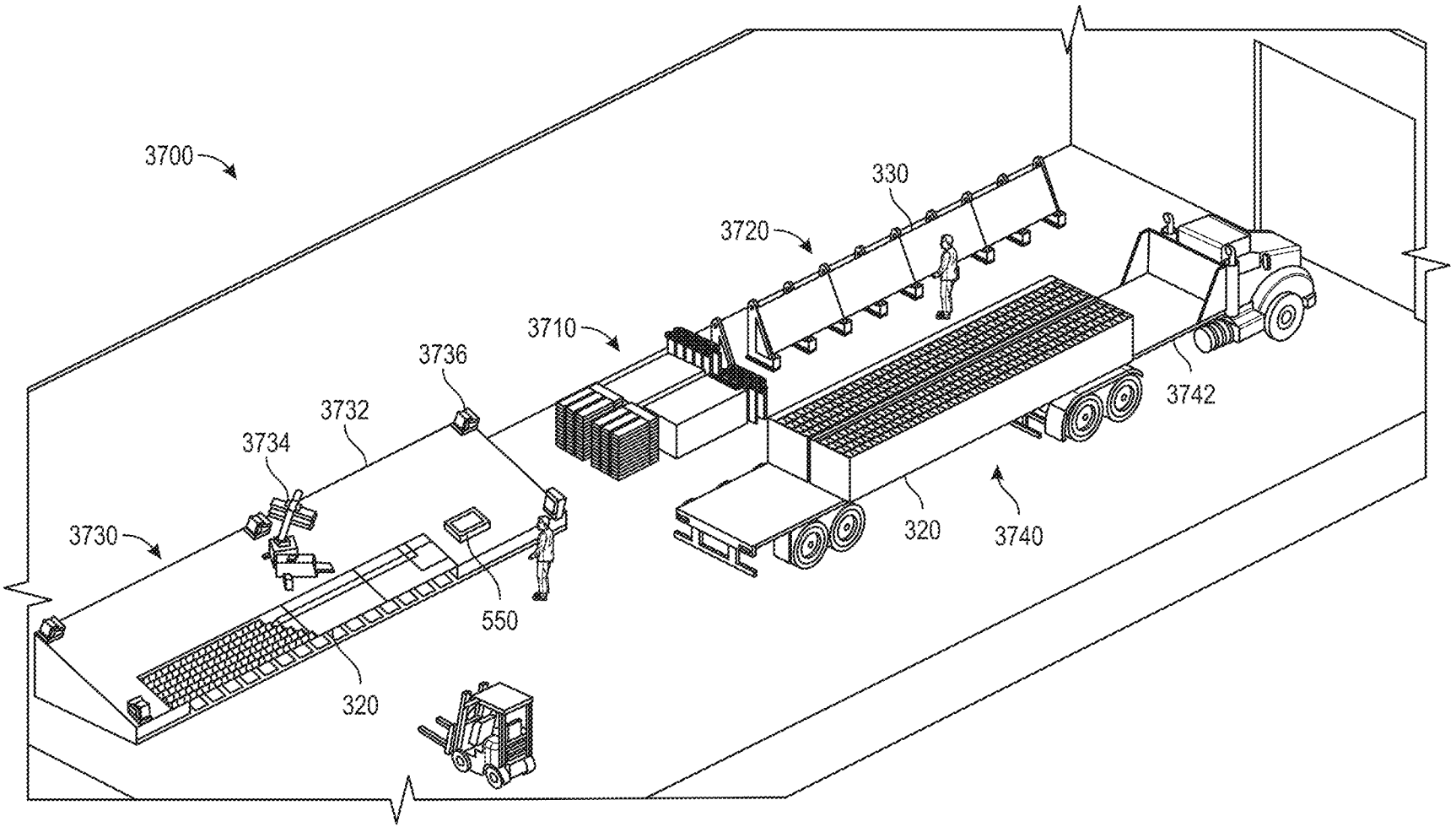
FIG. 37 illustrates an off-site location for prefabricating roof panels, configured in accordance with embodiments of the present technology.

FIG. 37 illustrates an off-site location 3700 (e.g., a factory) for prefabricating roof panels, configured in accordance with embodiments of the present technology. The off-site location 3700 can include a first zone 3710, a second zone 3720, a third zone 3730, and a fourth zone 3740. At the first zone 3710, components of a base member of a roof panel can be stacked and ready to be assembled. For example, boards (e.g., plywood boards), splice plates, drip edges, flashings, IWS, underlayment, and/or fasteners can be stored at the first zone 3710. At the second zone 3720, an operator can assemble the components from the first zone 3710 to form the first layer 330, as shown, and subsequently dispose a second layer (e.g., the second layer 440 of FIG. 4) thereon. For example, the operator can manually couple adjacent boards together using splice plates and fasteners, and couple drip edges and/or flashings to the edges of the boards.

At the third zone 3730, the base member (e.g., the first layer 330 and the second layer 440 thereon) formed at the second zone 3720 can be placed on a platform 3732. The platform 3732 can be angled, as shown, or flat relative to a direction of gravity. Then, the shingles 550 can be installed on the base member manually and/or via a robot. In the illustrated embodiment, an apparatus 3734 operates on the platform 3732 to apply the shingles 550 onto the base member to prefabricate the roof panel 320. The apparatus 3734 can include features for picking up and coupling the shingles 550 onto the base member (e.g., via nails). In some embodiments, the roof panel 320 is prefabricated on the platform 3732 one at a time, so the size of the platform 3732 need not match that of the entire roof on which the roof panel 320 is to be installed, and can be sized to provide sufficient space for the roof panel 320 and the apparatus 3734 to operate thereon.

In some embodiments, the apparatus 3734 navigates across the platform 3732 using cables (not shown) that extend between the apparatus 3734 and a plurality of anchors 3736 installed along edges and/or corners the platform 3732. Examples of the apparatus 3734 and the anchors 3736 are described in U.S. patent application Ser. No. 18/351,273, titled "DEVICES CONFIGURED TO OPERATE ON AN ANGLED SURFACE, AND ASSOCIATED SYSTEMS AND METHODS," and U.S. Provisional Application No. 63/620,145, titled "DEVICES CONFIGURED TO OPERATE ON AN ANGLED SURFACE, AND ASSOCIATED SYSTEMS AND METHODS," the disclosures of which are incorporated herein by reference in their entireties.

At the fourth zone 3740, the prefabricated roof panels 320 can stacked on a truck 3742 or other transportation vehicle. The truck 3742 can then transport the prefabricated roof panels 320 from the off-site location 3700 to the location of the roof on which the roof panels 320 are to be installed.

It will be appreciated that while FIG. 37 illustrates application of the shingles 550 using the apparatus 3734 and the anchors 3736, the shingles 550 can be applied at the third zone 3730 using other devices and/or manually. Also, while FIG. 37 illustrates the prefabrication of the eave roof panel 320, it will be appreciated that other roof panels configured in accordance with embodiments of the present technology, such as the subsequent roof panel 720, the roof panel 2120, the roof panel 2720, and the roof panel 3220, can be prefabricated in substantially the same or similar manner.

With reference to FIGS. 1-37, roof panels configured in accordance with embodiments of the present technology can accommodate various types and sizes of roofs without being constrained by, e.g., transportation parameters (e.g., the maximum roof panel size that a truck can carry). Moreover, because individual roof panels are prefabricated (e.g., by automated robots) with shingles properly arranged and installed off-site, embodiments of the present technology can reduce the on-site labor of installing roof shingles by 90% or more compared to conventional installation procedures. Also, the roof panels are designed for easy coupling to one another to streamline the on-site labor of coupling adjacent roof panels, thereby requiring minimal skill level. And as discussed above with reference to FIG. 2, the roof panels can be prefabricated with solar panels, inverters, rack mounts, etc. to further reduce on-site labor. The reduction in on-site labor and skill level required can translate to faster, cheaper, more reliable, and safer roof installation.

VI. Examples

The present technology is illustrated, for example, according to various aspects described below as numbered examples (1, 2, 3, etc.) for convenience. These are provided as examples and do not limit the present technology. It is noted that any of the dependent examples may be combined in any combination, and placed into a respective independent example. The other examples can be presented in a similar manner.

1. A roof panel, comprising:
a first layer;
a second layer disposed over the first layer; and
a plurality of shingles disposed over the second layer and arranged in partially overlapping rows.
2. The roof panel of any one of the examples herein, wherein the roof panel is configured to be prefabricated off-site and installed on a roof on-site.
3. The roof panel of any one of the examples herein, further comprising a plurality of fasteners coupling the plurality of shingles to the first layer, wherein individual ones of the plurality of fasteners are coupled to a first one of the shingles in row n and a second one of the shingles in row n−1.
4. The roof panel of any one of the examples herein, wherein individual ones of the plurality of fasteners are covered by a third one of the shingles in row n+1.
5. The roof panel of any one of the examples herein, wherein each of the shingles comprises a top portion, a middle portion, and a bottom portion, wherein individual ones of the plurality of fasteners are coupled to (i) the middle portion of the first one of the shingles in row n and (ii) the top portion of the second one of the shingles in row n−1.
6. The roof panel of any one of the examples herein, wherein the top portions of a topmost row of the shingles are not coupled to the plurality of fasteners.
7. The roof panel of any one of the examples herein, wherein the roof panel comprises an eave roof panel, wherein the first layer and the second layer have same dimensions, and wherein the roof panel further comprises drip edges coupled along the side edges and bottom edge of the first layer.
8. The roof panel of any one of the examples herein, wherein the roof panel comprises a subsequent roof panel, wherein the second layer extends past a bottom edge of the first layer, and wherein the roof panel further comprises drip edges coupled along the side edges of the first layer and extending past the bottom edge of the first layer.
9. The roof panel of any one of the examples herein, wherein the first layer comprises one or more plywood boards.
10. The roof panel of any one of the examples herein, wherein the second layer comprises at least one of an ice and water shield (IWS) or an underlayment.
11. The roof panel of any one of the examples herein, wherein the shingles are made of composites of asphalt and fiberglass matt.
12. The roof panel of any one of the examples herein, further comprising solar panel rack mounts coupled to at least one of the second layer or the shingles.
13. A method for installing roof panels on a roof, the method comprising:
coupling a first roof panel to the roof, wherein the first roof panel comprises a plurality of first shingles;
coupling a second roof panel to the roof and immediately above the first roof panel, wherein the second roof panel comprises a plurality of second shingles; and
coupling the second roof panel to the first roof panel.
14. The method of any one of the examples herein, wherein coupling the second roof panel to the first roof panel comprises:
placing individual ones of the second shingles in a first row of the second shingles partially over individual ones of the first shingles in a topmost row of the first shingles; and
coupling a plurality of fasteners to (i) the individual ones of the second shingles in the first row of the second shingles and (ii) the individual ones of the first shingles in the topmost row of the first shingles.
15. The method of any one of the examples herein, wherein coupling the second roof panel to the first roof panel further comprises:
placing individual ones of the second shingles in a second row of the second shingles (i) partially over the individual ones of the second shingles in the first row of the second shingles and (ii) over the plurality of fasteners.
16. The method of any one of the examples herein, wherein coupling the second roof panel to the first roof panel comprises:
abutting a bottom edge of a first layer of the second roof panel against a top edge of a first layer of the first roof panel; and
placing a second layer of the second roof panel partially over a second layer of the first roof panel.
17. The method of any one of the examples herein, wherein coupling the first roof panel to the roof comprises coupling the first roof panel to a plurality of brackets coupled to rafters of the roof.
18. The method of any one of the examples herein, wherein coupling the second roof panel to the roof comprises coupling the second roof panel to a plurality of brackets coupled to rafters of the roof.
19. A method for installing roof panels on a roof, the method comprising:
coupling a left roof panel to the roof, wherein the left roof panel comprises a plurality of left shingles;

coupling a right roof panel to the roof and partially overlapping with the left roof panel, wherein the right roof panel comprises a plurality of right shingles; and coupling a plurality of intermediate shingles between the plurality of left shingles and the plurality of right shingles.

20. The method of any one of the examples herein, wherein the left roof panel includes a left first layer having a left milled region, wherein the right roof panel includes a right first layer having a right milled region, and wherein coupling the right roof panel comprises positioning the right milled region in an overlapping arrangement with the left milled region.

21. The method of any one of the examples herein, wherein coupling the left roof panel to the roof comprises positioning a rightmost edge of the left roof panel along a center of a rafter of the roof.

22. A roof panel, comprising:

a base member configured to be installed at an angle relative to a gravitational force; and a plurality of shingles disposed over the base member, wherein the plurality of shingles includes a first shingle, a second shingle, and a third shingle, wherein each of the plurality of shingles includes a top portion, a middle portion, and a bottom portion, wherein the middle portion of the second shingle is coupled to the top portion of the first shingle and the base member, and wherein the middle portion of the third shingle is coupled to the top portion of the second shingle and the base member.

23. The roof panel of any one of the examples herein, wherein the bottom portion of the second shingle covers at least a portion of the middle portion of the first shingle, and wherein the bottom portion of the third shingle covers at least a portion of the middle portion of the second shingle.

VII. Conclusion

It will be apparent to those having skill in the art that changes may be made to the details of the above-described embodiments without departing from the underlying principles of the present disclosure. In some cases, well known structures and functions have not been shown or described in detail to avoid unnecessarily obscuring the description of the embodiments of the present technology. Although steps of methods may be presented herein in a particular order, alternative embodiments may perform the steps in a different order. Similarly, certain aspects of the present technology disclosed in the context of particular embodiments can be combined or eliminated in other embodiments. Furthermore, while advantages associated with certain embodiments of the present technology may have been disclosed in the context of those embodiments, other embodiments can also exhibit such advantages, and not all embodiments need necessarily exhibit such advantages or other advantages disclosed herein to fall within the scope of the technology. Accordingly, the disclosure and associated technology can encompass other embodiments not expressly shown or described herein, and the invention is not limited except as by the appended claims.

To the extent any material incorporated herein by reference conflicts with the present disclosure, the present disclosure controls. Where the context permits, singular or plural terms may also include the plural or singular term, respectively. For example, throughout this disclosure, the singular terms "a," "an," and "the" include plural referents unless the context clearly indicates otherwise. Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Furthermore, as used herein, the phrase "and/or" as in "A and/or B" refers to A alone, B alone, and both A and B. Additionally, the terms "comprising," "including," "having," and "with" are used throughout to mean including at least the recited feature(s) such that any greater number of the same features and/or additional types of other features are not precluded. Moreover, as used herein, the phrases "based on," "depends on," "as a result of," and "in response to" shall not be construed as a reference to a closed set of conditions. For example, a step that is described as "based on condition A" may be based on both condition A and condition B without departing from the scope of the present disclosure. In other words, as used herein, the phrase "based on" shall be construed in the same manner as the phrase "based at least in part on" or the phrase "based at least partially on."

Reference herein to "one embodiment," "an embodiment," "some embodiments" or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

Unless otherwise indicated, all numbers expressing numerical values used in the specification and claims, are to be understood as being modified in all instances by the term "about." Accordingly, unless indicated to the contrary, the numerical parameters set forth in the specification and attached claims are approximations that may vary depending upon the desired properties sought to be obtained by the present technology. At the very least, and not as an attempt to limit the application of the doctrine of equivalents to the scope of the claims, each numerical parameter should at least be construed in light of the number of reported significant digits and by applying ordinary rounding techniques. The terms "about," "approximately," and "substantially" as used herein shall be interpreted to mean within ±10% of the stated value. Additionally, all ranges disclosed herein are to be understood to encompass the endpoints, and any and all subranges subsumed therein. For example, a range of "1 to 10" includes any and all subranges between (and including) the minimum value of 1 and the maximum value of 10 (e.g., any and all subranges having a minimum value of equal to or greater than 1 and a maximum value of equal to or less than 10, such as 5.5 to 10).

The disclosure set forth above is not to be interpreted as reflecting an intention that any claim or example requires more features than those expressly recited in that claim or example. Rather, as the preceding examples and the following claims reflect, inventive aspects lie in a combination of fewer than all features of any single foregoing disclosed embodiment. Thus, the preceding examples and the following claims are hereby expressly incorporated into the Detailed Description, with each claim standing on its own as a separate embodiment. This disclosure includes all permutations of the independent claims with their dependent claims.

What is claimed is:

1. A roof panel for placement on a roof, the roof panel comprising:

a structural layer configured to be coupled to the roof;

a protective layer disposed over the structural layer, wherein the protective layer is configured to protect the structural layer and/or the roof from elements;

a plurality of shingles disposed over the protective layer and arranged in a plurality of rows including a first row and a second row immediately adjacent the first row, wherein each of the plurality of shingles includes a top portion, a middle portion, and a bottom portion, and wherein individual shingles in the first row at least partially overlap individual shingles in the second row, such that the bottom portions of shingles in the second row at least partially cover the top portions and the middle portions of shingles in the first row;

a first plurality of fasteners coupling the middle portions of the shingles in the first row to the structural layer and the protective layer; and a second plurality of fasteners coupling the middle portions of the shingles in the second row and the top portions of the shingles in the first row to the structural layer and the protective laver, wherein the top portion of the shingles in the second row do not include fasteners extending therethrough.

2. The roof panel of claim 1, further comprising a plurality of fasteners coupling (i) the middle portion of the shingles in the second row, (ii) the top portions of the shingles in the first row, (iii) the protective layer, and (iv) the structural layer.

3. The roof panel of claim 2, wherein the plurality of fasteners are covered by the bottom portions of shingles in a third row of the plurality of rows immediately above the second row.

4. The roof panel of claim 1, wherein the top portions of shingles in a topmost row of the plurality of rows are not directly coupled to the protective layer or the structural layer.

5. The roof panel of claim 1, wherein the roof panel is an eave roof panel configured to be placed along an eave of the roof, and wherein the roof panel further comprises a plurality of fasteners coupling the middle portions of the shingles in the first row to the protective layer and the structural layer.

6. The roof panel of claim 1, wherein the roof panel is a subsequent roof panel configured to be placed away from an eave of the roof, and wherein the middle portions of the shingles in the first row are not directly coupled to the protective layer or the structural layer.

7. The roof panel of claim 1, wherein the structural layer has a triangular recessed portion at a side edge of the structural layer, wherein the protective layer has a diagonal edge aligned with a hypotenuse of the triangular recessed portion, and wherein a subset of the plurality of shingles arranged in different ones of the plurality of rows and disposed adjacent to the diagonal edge of the protective layer are arranged in a laterally staggered manner such that the subset of the plurality of shingles generally align with the diagonal edge of the protective layer.

8. The roof panel of claim 1, wherein the shingles are composed of a composite of asphalt and fiberglass matt.

9. The roof panel of claim 1, wherein the structural layer includes:

a plurality of plywood boards arranged laterally; and a plurality of splice plates coupling adjacent ones of the plywood boards, wherein the splice plates are attached to rear sides of the plywood boards, and wherein the splice plates each include a tip (i) extending beyond top edges of the plywood boards and (ii) having an aperture sized to receive a lifting wire.

10. The roof panel of claim 1, wherein the structural layer includes:

an exterior sheathing layer;

an interior sheathing layer;

an insulating layer disposed between the exterior sheathing layer and the interior sheathing layer, wherein each of the exterior sheathing layer, the interior sheathing layer, and the insulating layer comprises a continuous layer; and a plurality of blockings coupled to and protruding from the interior sheathing layer, wherein the blockings are spaced apart from one another along a length of the roof panel.

11. The roof panel of claim 1, wherein the protective layer includes:

an ice and water shield (IWS) layer disposed over an edge portion of the structural layer; and an underlayment disposed over a remaining portion of the structural layer, wherein an interface between the IWS layer and the underlayment is watertight.

12. The roof panel of claim 1, wherein the roof panel has a length of about 24 feet and a height of about 4 feet.

13. The roof panel system of claim 1, wherein, for each of the plurality of shingles, each of the top portion and the bottom portion is bendable with respect to the middle portion.

14. A roof panel system for placement on a roof, the roof panel system comprising:

an eave roof panel; and a subsequent roof panel, wherein each of the eave roof panel and the subsequent roof panel includes:

a first layer configured to be coupled to the roof, a second layer disposed over the first layer, shingles disposed over the second layer and arranged in a plurality of rows including a first row and a second row, wherein each of the shingles includes a top portion, a middle portion, and a bottom portion, a first plurality of fasteners coupling the middle portions of shingles in the first row to the structural layer and the protective laver, and a second plurality of fasteners coupling the middle portions of shingles in the second row and the top portions of the shingles in the first row to the structural layer and the protective layer, wherein the top portions of the shingles in the second row do not include fasteners extending therethrough, and wherein the roof panel system is configured such that, when placed on the roof:

the subsequent roof panel is placed above the eave roof panel, the second layer of the subsequent roof panel is disposed at least partially over the second layer of the eave roof panel, and shingles in a topmost row of the eave roof panel are disposed at least partially between (i) the second layer of the subsequent roof panel and (ii) shingles in a bottommost row of the subsequent reed-roof panel.

15. The roof panel system of claim 14, wherein, for each of the eave roof panel and the subsequent roof panel:

each of the shingles includes a top portion, a middle portion, and a bottom portion, and individual shingles in adjacent rows at least partially overlap such that the bottom portions of shingles in a second row of the plurality of rows at least partially cover the top portions and the middle portions of shingles in a first row of the plurality of rows immediately below the second row.

16. The roof panel system of claim 14, wherein:

the cave roof panel is a first eave roof panel, the roof panel system further comprises a second eave roof panel, the first layer of the first eave roof panels includes a first triangular recessed portion at a front side of the first layer of the first eave roof panels, the first layer the second eave roof panels includes a second triangular recessed portion at a rear side of the first layer of the second one of the eave roof panels, and the roof panel system is configured such that, when placed on the roof:

the second eave roof panels is disposed at least partially over the first eave roof panels such that the second triangular recessed portion interfaces the first triangular recessed portion, and the roof panel system does not include shingles positioned between the shingles of the first eave roof panels and the shingles of the second the cave roof panels.

17. The roof panel system of claim 14, further comprising a plurality of brackets configured to couple the first layers of the eave roof panel and the subsequent roof panel to the roof.

18. The roof panel system of claim 14, wherein the first layers of the eave roof panel and the subsequent roof panel each include a structural insulated panel (SIP) and a plurality of blockings coupled to and protruding from a rear side of the SIP, wherein the blockings are (i) spaced apart from one another along a length of the respective eave roof panel or subsequent roof panel and (ii) configured to be coupled to the roof.

19. The roof panel system of claim 14, wherein the subsequent roof panel is a first subsequent roof panel, wherein the roof panel system further includes a second subsequent roof panel, and wherein the roof panel system is configured such that, when placed on the roof, the second subsequent roof panel is placed above the first subsequent roof panel.

* * * * *